US011002104B2

(12) United States Patent
Wolf et al.

(10) Patent No.: US 11,002,104 B2
(45) Date of Patent: May 11, 2021

(54) PLUG ASSEMBLIES FOR A SUBTERRANEAN WELLBORE

(71) Applicant: National Oilwell Varco, L.P., Houston, TX (US)

(72) Inventors: John Chrysostom Wolf, Spring, TX (US); Aju Abraham, Houston, TX (US); Brian Paul Brubaker, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 162 days.

(21) Appl. No.: 16/294,649

(22) Filed: Mar. 6, 2019

(65) Prior Publication Data

US 2019/0352998 A1 Nov. 21, 2019

Related U.S. Application Data

(60) Provisional application No. 62/672,872, filed on May 17, 2018, provisional application No. 62/686,814, filed on Jun. 19, 2018.

(51) Int. Cl.
*E21B 33/128* (2006.01)
*E21B 33/129* (2006.01)
*E21B 33/1295* (2006.01)

(52) U.S. Cl.
CPC ..... *E21B 33/1285* (2013.01); *E21B 33/1295* (2013.01)

(58) Field of Classification Search
CPC .. E21B 33/128; E21B 33/129; E21B 33/1291; E21B 33/1292; E21B 33/1295;
(Continued)

(56) References Cited

U.S. PATENT DOCUMENTS 2,155,380 A * 4/1939 Bean ..... E21B 23/01 166/123
5,058,671 A * 10/1991 Cochran ..... E21B 33/129 166/124

(Continued)

FOREIGN PATENT DOCUMENTS

WO 2017/052510 A1 3/2017

OTHER PUBLICATIONS

International Patent Application No. PCT/US2019/021016, International Search Report and Written Opinion dated Jun. 12, 2019, (14 pages).

*Primary Examiner* — Kenneth L Thompson
(74) *Attorney, Agent, or Firm* — Conley Rose, P.C.

(57) ABSTRACT

Plug assemblies for plugging a wellbore tubular and methods relating thereto are disclosed. In an embodiment, the plug assembly includes a central axis and a seal sub including a plurality of axially extending fingers and a tapered outer surface. In addition, the plug assembly includes a sealing element coupled to the axially extending fingers of the seal sub. Further, the plug assembly includes a slip sub including a tapered inner surface, and a plurality of axially extending fingers. The fingers of the slip sub each include one or more teeth. The seal sub is configured to be at least partially inserted within the slip sub so that the tapered outer surface engages with the tapered inner surface, and axial advance of the tapered inner surface within the tapered outer surface is to radially expand the fingers of the slip sub to engage with an inner surface of the tubular.

20 Claims, 20 Drawing Sheets

(58) Field of Classification Search
CPC ... E21B 33/1293; E21B 23/06; E21B 23/0413
See application file for complete search history.

(56) References Cited

U.S. PATENT DOCUMENTS

| | | | | |
|---|---|---|---|---|
| 5,058,672 | A * | 10/1991 | Cochran | E21B 33/129 166/124 |
| 9,835,003 | B2 * | 12/2017 | Harris | E21B 43/26 |
| 10,066,453 | B2 * | 9/2018 | Silva | E21B 33/134 |
| 10,605,018 | B2 * | 3/2020 | Schmidt | E21B 33/1293 |
| 2015/0101796 | A1 | 4/2015 | Davies et al. | |
| 2016/0123100 | A1 | 5/2016 | Tse | |
| 2016/0123104 | A1 | 5/2016 | Harris | |
| 2020/0157914 | A1 * | 5/2020 | Graham | E21B 33/134 |

* cited by examiner

PLUG ASSEMBLIES FOR A SUBTERRANEAN WELLBORE

CROSS-REFERENCE TO RELATED APPLICATIONS

This application claims benefit of U.S. provisional patent application Ser. No. 62/672,872 filed May 17, 2018, and entitled "Plug Assemblies for a Subterranean Wellbore," and U.S. Provisional patent application Ser. No. 62/686,814, filed Jun. 19, 2018, and entitled "Plug Assemblies for a Subterranean Wellbore," both of which are hereby incorporated herein by reference.

STATEMENT REGARDING FEDERALLY SPONSORED RESEARCH OR DEVELOPMENT

Not applicable.

BACKGROUND

This disclosure relates to the production of hydrocarbons from a subterranean wellbore. More particularly, this disclosure relates to plugs and plug assemblies for use within a subterranean wellbore.

Plugs are used within tubular members or pipe strings extending within a subterranean wellbore (e.g., a casing or production string) to define and seal off multiple sections of zones of the wellbore tubular. Some plugs are used to contain hydraulic pressure within a desired section of the wellbore tubular during a hydraulic fracturing operation. Plugs used for this sort of application are typically referred to as "frac plugs." Frac plugs are manufactured from a wide range of materials including, as examples, cast iron, aluminum, composite or even dissolvable alloys. Once the hydraulic fracturing operation is complete, the plugs are no longer required and are removed. Removal of a frac plug may be accomplished by milling or cutting (e.g., with a bit) the frac plug out of the casing. Alternatively, for designs that utilize a dissolvable alloy or other material, the plug may simply dissolve (either partially or entirely) over time.

BRIEF SUMMARY OF THE DISCLOSURE

Some embodiments disclosed herein are directed to a plug assembly for plugging a wellbore tubular. In an embodiment, the plug assembly has a central axis and includes a seal sub comprising a plurality of axially extending fingers and a tapered outer surface. In addition, the plug assembly includes a sealing element coupled to the axially extending fingers of the seal sub. Further, the plug assembly includes a slip sub including a tapered inner surface, and a plurality of axially extending fingers. The fingers of the slip sub each include one or more teeth. The seal sub is configured to be at least partially inserted within the slip sub so that the tapered outer surface engages with the tapered inner surface, and an axial advance of the tapered inner surface within the tapered outer surface is configured to radially expand the fingers of the slip sub.

Other embodiments disclosed herein are directed to a method of installing a plug assembly within a wellbore tubular. In an embodiment, the method includes (a) inserting the plug assembly into the wellbore tubular. The plug assembly has a central axis and includes a ball seat comprising a landing surface, a seal sub including a plurality of axially extending fingers and a tapered outer surface, a sealing element coupled to the seal sub, and a slip sub including a tapered inner surface and a plurality of axially extending fingers. The fingers of the slip sub each include one or more teeth. In addition, the method includes (b) axially advancing the tapered inner surface of the slip sub over the tapered outer surface of the seal sub, and (c) radially expanding the axially extending fingers of the slip sub to engage the one or more teeth with an inner wall of the wellbore tubular during (b). Further, the method includes (d) axially advancing the ball seat within the seal sub, and (e) radially expanding the axially extending fingers of the seal sub and the sealing element toward the inner wall of the wellbore tubular during (d).

Still other embodiments disclosed herein are directed to a plug assembly for plugging a wellbore tubular. In an embodiment, the plug assembly includes a ball seat including a landing surface and a frustoconical outer surface. The landing surface is configured to engage with a plugging member. In addition, the plug assembly includes a seal sub including a plurality of axially extending fingers a frustoconical inner surface, and a tapered outer surface. Further, the plug assembly includes a sealing element coupled to the frustoconical outer surface of the ball seat and the frustoconical inner surface of the seal sub, and a slip sub comprising a plurality of axially extending fingers, each including one or more teeth, and a tapered inner surface. The ball seat is at least partially received within the seal sub. The seal sub is at least partially received within the slip sub such that the tapered outer surface of the seal sub is engaged with the tapered inner surface of the slip sub. Axial advance of the ball seat into the seal sub is configured to radially expand the fingers of the seal sub and the sealing element, and axial advance of the tapered outer surface of the seal sub within the tapered inner surface of the slip sub is configured to radially expand the fingers of the slip sub.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF EXEMPLARY EMBODIMENTS

Figure 1:
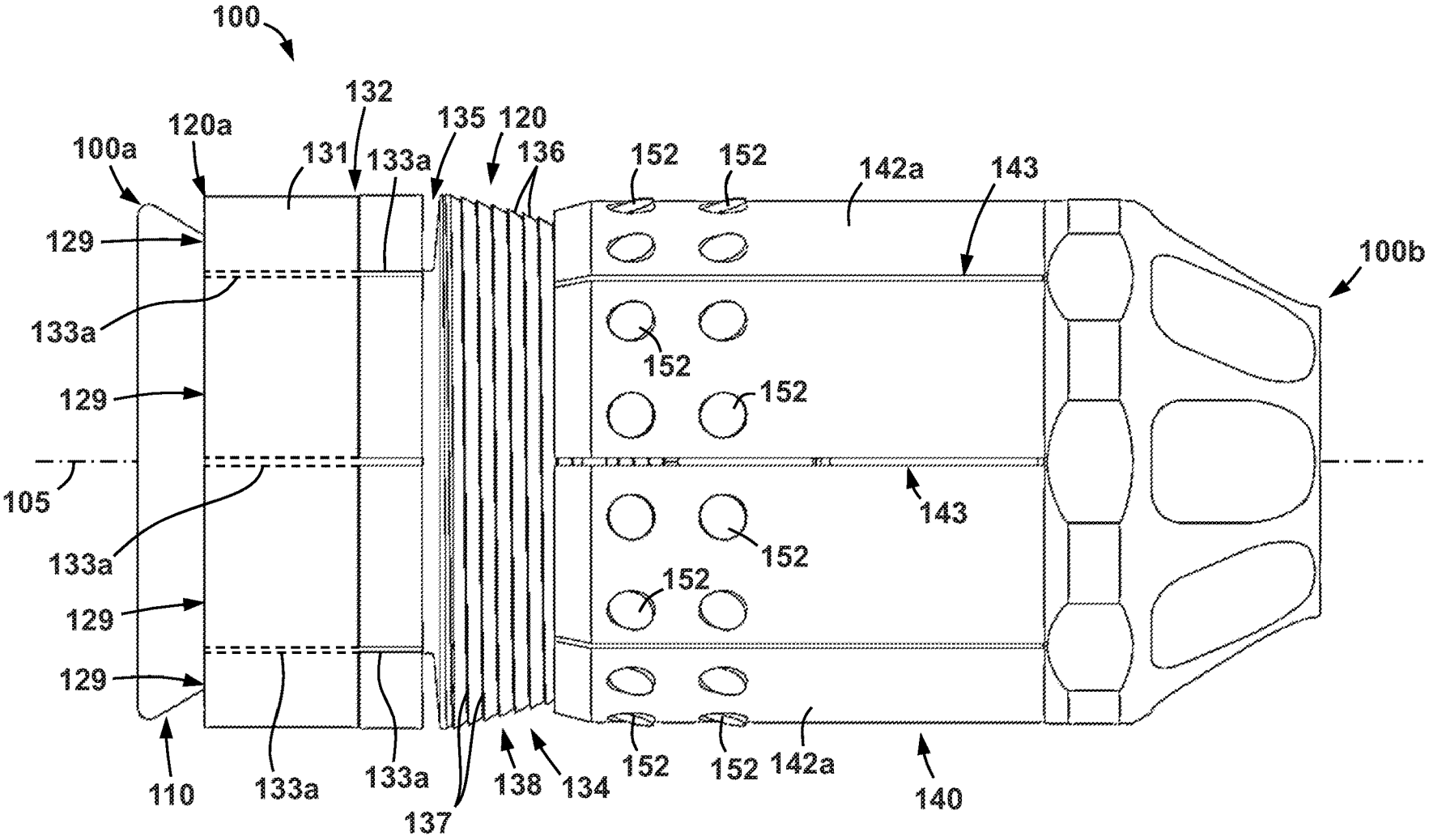
FIG. 1 is a side view of a plug assembly for use within a subterranean wellbore tubular according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, any reference to up or down in the description and the claims is made for purposes of clarity, with "up", "upper", "upwardly", "uphole", or "upstream" meaning toward the surface of the wellbore or borehole and with "down", "lower", "downwardly", "downhole", or "downstream" meaning toward the terminal end of the wellbore or borehole, regardless of the wellbore or borehole orientation. Also, when used herein (including in the claims), the words "about," "generally," "substantially," "approximately," and the like mean within a range of plus or minus 10%.

As previously described above, plugs are used in various applications within a subterranean wellbore, such as, for example, to separate and seal off multiple sections or zones within the wellbore during a hydraulic fracturing operation. Many conventional plugs require a large number of parts and components, and this typically serves to increase their overall size. As the size of a plug increases, the amount of material that is to subsequently be either milled or dissolved from the wellbore when the plug is no longer needed also increases. In addition, it is possible that a plug may not adequately engage with an inner wall of a wellbore tubular (e.g., a casing pipe) when the plug is initially installed. If this should occur, subsequent high pressure operations (e.g., hydraulic fracturing) will be frustrated due to an inadequate seal between the designated zones or sections of the wellbore on either side of the plug. Accordingly, embodiments disclosed herein include plug assemblies for use within a subterranean wellbore. At least some of the embodiment disclosed herein include a fewer number of components than a convention plug, and thus, are easier to either mill or dissolve out of the wellbore once the plug is no longer needed. In addition, at least some of the embodiments disclosed herein are configured such that radial pressure exerted on the sealing element within the plug is enhanced by subsequent high pressure operations that take place after installation of the plug within the wellbore. As a result, these embodiments may be able to maintain a higher quality seal within the wellbore more often than conventional plug designs.

Figure 2:
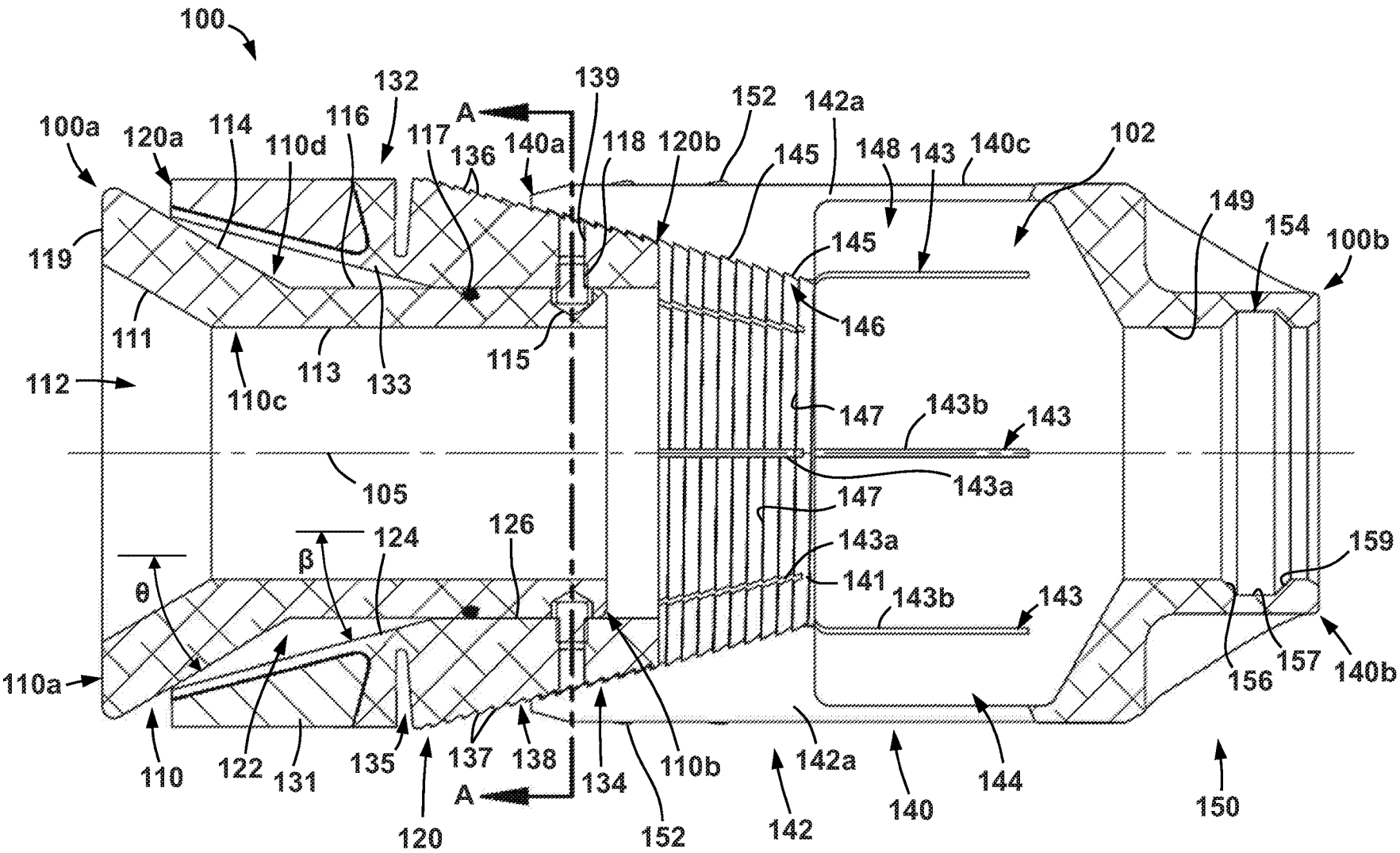
FIG. 2 is a side cross-sectional view of the plug assembly of FIG. 1.

Referring now to FIGS. 1 and 2, an embodiment of a plug assembly 100 for use within a subterranean wellbore tubular is shown. In some embodiments, plug assembly 100 may be used as a frac plug. Plug assembly 100 generally includes a central or longitudinal axis 105, a first or uphole end 100*a*, and a second or downhole end 100*b* opposite uphole end 100*a* along axis 105. In addition, plug assembly 100 includes a ball seat 110 extending from uphole end 100*a*, a slip sub 140 extending from downhole end 100*b*, and a seal sub 120 extending and coupled between the ball seat 110 and slip sub 140.

Ball seat 110 is a generally tubular member that includes a first or uphole end 110*a*, a second or downhole end 110*b* opposite uphole end 110*a*, a radially inner surface 110*c* extending between ends 110*a*, 110*b*, and a radially outer surface 110*d* also extending between ends 110*a*, 110*b*. When plug assembly 100 is undeployed (that is, plug assembly 100 is not sealingly engaged within a subterranean wellbore), uphole end 110*a* is coincident with uphole end 100*a* of plug assembly 100. In addition, uphole end 110*a* of seat 110 defines an annular engagement surface 119 that engages with a corresponding surface on a setting tool adapter (e.g., setting tool adapter 200) as described in more detail below.

Radially inner surface 110*c* defines a throughbore 112 extending axially between ends 110*a*, 110*b* that includes a frustoconical landing surface 111 extending from engagement surface 119, and a cylindrical surface 113 extending axially from frustoconical surface 111 to downhole end 110*b*. Frustoconical landing surface 111 tapers radially inward toward axis 105 when moving axially from engagement surface 119 to cylindrical surface 113. As will be described in more detail below, frustoconical landing surface 111 is configured to engage with an flowable plug member to close off a central passage (e.g., central passage 102 described below) during operations in the wellbore. In some embodiments, the flowable plug member may comprise a ball (e.g., ball 300 described below); however, any suitable plugging member that may be inserted and flowed through the wellbore to land on surface 111 may be utilized (e.g., a dart). Thus, references to a ball and referencing the seat 110 as a "ball seat" are not meant to limit the type of plugging member that may be used.

Radially outer surface 110*d* includes a frustoconical surface 114 extending from engagement surface 119, and a cylindrical surface 116 extending axially from frustoconical surface 114 to downhole end 110*b*. Frustoconical surface 114 tapers radially inward toward axis 105 when moving axially from engagement surface 119 at an angle θ relative to central axis 105 that ranges from about 30° to about 45°. In other embodiments, the angle θ may range from about 35° to about 40°, or from about 32° to about 38°.

Figure 3:
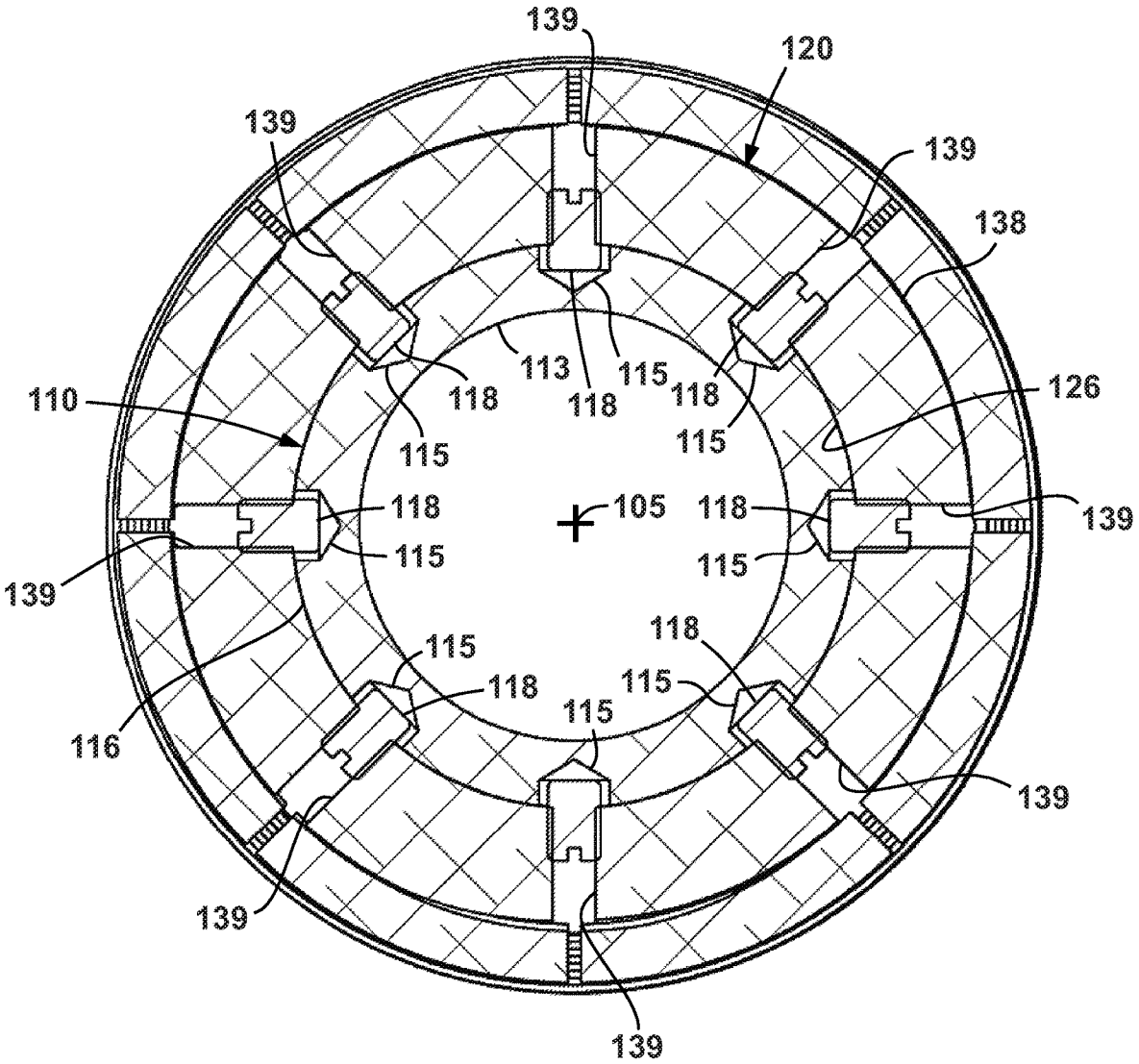
FIG. 3 is a cross-sectional view of the plug assembly along section A-A in FIG. 2.

A sealing ring 117 (e.g., an O-ring or other suitable sealing member) is disposed within an annular channel extending radially inward from cylindrical surface 116. In addition, ball seat 110 includes a plurality of recesses 115 extending radially inward from cylindrical surface 116. In particular, as is best shown in FIG. 3, in this embodiment, ball seat 110 comprises seven recesses 115 that are evenly circumferentially spaced about axis 105. Each recess 115 receives a shear pin 118 therethrough to selectively fix an initial relative axial and circumferential position of ball seat 110 and seal sub 120 (which is described in more detail below).

Referring still to FIGS. 1 and 2, seal sub 120 is a generally tubular member that includes a first or uphole end 120*a*, a second or downhole end 120*b* opposite uphole end 120*a*, a sealing portion or section 132 extending from uphole end 120*a* to a circumferential groove or channel 135, and a coupling portion or section 134 extending from channel 135 to downhole end 120*b*. In addition, seal sub 120 includes a throughbore 122 extending axially between ends 120*a*, 120*b* along axis 105 that is defined by a frustoconical surface 124 extending from uphole end 120*a* and a cylindrical surface 126 extending axially from frustoconical surface 124 to downhole end 120*b*. Frustoconical surface 124 tapers radially inward toward axis 105 when moving axially from uphole end 120*a* at an angle β relative to central axis 105 that ranges from about 10° to about 30°. In other embodiments, the angle β ranges from about 15° to about 25°, or from about 18° to about 22°. In at least some embodiments, the angle β of surface 124 is mismatched or different than the angle θ of surface 114 of ball seat 110. For example, the difference between the angles θ, β may range from about 15° to about 20°. In at least some of these embodiments, the angle θ may be greater than the angle β; however, the opposite may be true in other embodiments. As will be described in more detail below, the mismatch or difference between the angles θ, β of surfaces 114, 124, respectively, may create an interference between surfaces 114, 124 to enhance a radial loading between ball seat 110 and seal sub 120 during operations. Of course, it should be appreciated that in some embodiments, the angles θ, β of surfaces 114, 124 are substantially equal.

Sealing section 132 includes a sealing element 131 bonded to a rigid support 133. In this embodiment, rigid support 133 is integral with coupling section 134 and thus comprises the same material (e.g., a metal, composite, dissolvable alloy, etc.). Sealing element 131 may comprises a compliant and/or elastomeric member that may sealingly engage with an inner surface of a tubular (e.g., a casing pipe disposed within a subterranean wellbore) to seal off the central passage of the tubular during operations. As is best shown in FIG. 1, rigid support 133 is separated into a plurality of axially extending collets or fingers 129 by a plurality of axially extending slots 133*a* that extend from circumferential groove 135 to uphole end 120*a*. In this embodiments, collets 129 are evenly circumferentially spaced about axis 105. In addition, as is also best shown in FIG. 1, sealing element 131 is a circumferentially member that is bonded both to and between the collets 129 (note: the portions of slots 133*a* that are covered by sealing member 131 in FIG. 1 are represented with dotted lines).

Referring still to FIGS. 1 and 2, coupling section 134 includes a tapered outer surface 138 that tapers radially inward toward axis 105 when moving from circumferential groove 135 to downhole end 120*b*. In addition, tapered outer surface 138 includes a wicker style thread profile that includes a plurality of axially separated frustoconical surfaces 136 extending circumferentially about axis 105, and a plurality of shoulders 137 extending radially between axially adjacent frustoconical surfaces 136. As will be described below, the wicker thread profile defined by frustoconical surfaces 136 and shoulders 137 engages with a corresponding thread profile on an inner surface of slip sub 140 to secure seal sub 120 and slip sub 140 to one another during operations.

Coupling section 134 also includes a plurality of bores 139 that each extend radially from tapered outer surface 138 to cylindrical surface 126 of throughbore 122. As is best shown in FIGS. 2 and 3, each of the bores 139 is circumferentially aligned with one of recesses 115 on ball seat 110 when ball seat 110 is received within seal sub 120 as shown. As a result, the shear pins 118 (previously described) each extend through a corresponding pair of the recesses 115 and bores 139 between ball seat 110 and seal sub 120. In this embodiment, there are a total of seven bores 139 that are evenly circumferentially spaced about axis 105 along coupling section 134. Accordingly, shear pins 118 fix initial relative axial and circumferential positions of ball seat 110 and seal sub 120.

Referring again to FIGS. 1 and 2, slip sub 140 is a hollow member that includes a first or uphole end 140*a*, a second or downhole end 140*b* opposite uphole end 140*a*, a slip portion or section 142 extending from uphole end 140*a*, and a coupling portion or section 150 extending from slip section 142 to downhole end 140*b*. Downhole end 140*b* is coincident with downhole end 100*b* of plug assembly 100 when plug assembly 100 is inserted within a subterranean wellbore. In addition, slip sub 140 includes a radially outer surface 140*c* extending between ends 140*a*, 140*b*, and a through passage 144 that also extends between ends 140*a*, 140*b*. Passage 144 is defined by a tapered inner surface 146 extending from uphole end 140*a*, a central cavity 148 extending from tapered inner surface 146, and a cylindrical surface 149 extending from central cavity 148 to downhole end 140*b*. Tapered Inner surface 146 and central cavity 148 are both disposed within slip section 142 while cylindrical surface 149 is disposed within coupling section 150.

Tapered inner surface 146 tapers radially inward toward axis 105 when moving from uphole end 140*a* to central cavity 148. In addition, tapered inner surface 146 includes a wicker style thread profile that corresponds to the wicker style thread profile on tapered outer surface 138 of seal sub 120. In particular, the thread profile on tapered inner surface 146 includes a plurality of axially separated frustoconical surfaces 145 extending circumferentially about axis 105, and a plurality of shoulders 147 extending radially between axially adjacent frustoconical surfaces 145. As shown in FIG. 2, when coupling section 134 of seal sub 120 is inserted within slip section 142 of slip sub 140, surfaces 138, 146 engage with one another such that one or more of the frustoconical surfaces 136 are engaged with a corresponding one or more of the frustoconical surfaces 145, and one or more of the shoulders 137 are engaged with a corresponding one or more of the shoulders 147. As a result, when coupling section 134 of seal sub 120 is inserted within slip section 142 of slip sub 140 as described, the engagement between the corresponding shoulders 137, 147 of surfaces 138, 146, respectively, prevents (or at least restricts) the axial withdrawal of seal sub 120 from slip sub 140. In addition, as coupling section 134 of seal sub 120 is axially advanced within through passage 144 of slip sub 140, the sliding engagement between surfaces 138, 146, and progressive advancement of shoulders 137 of surfaces 138 past shoulders 147 of surface 146 provides a ratcheting engagement between seal sub 120 and slip sub 140.

Figure 4:
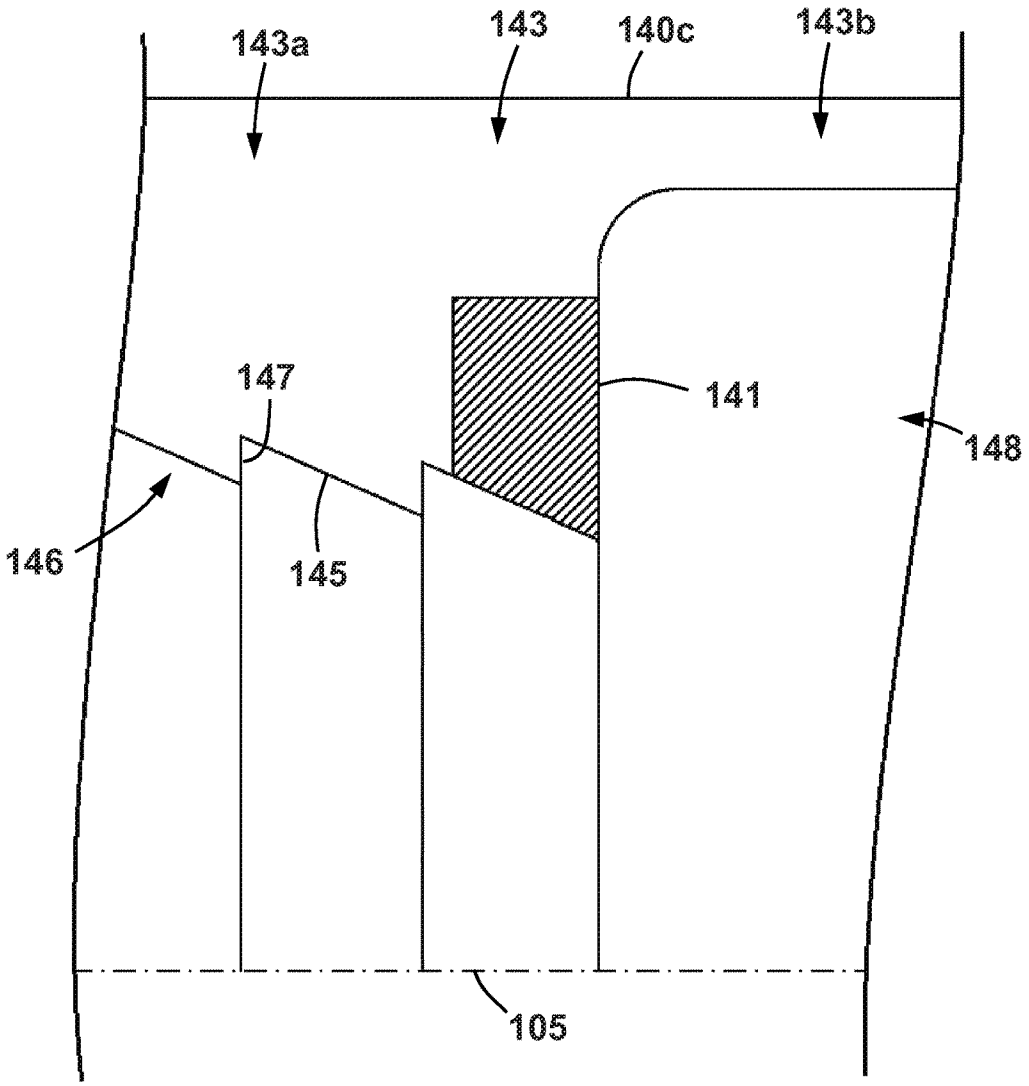
FIG. 4 is an enlarged cross-sectional view of one of the connecting members between the fingers of the slip sub for the plug assembly of FIG. 1.

Referring still to FIGS. 1 and 2, a plurality of axially extending slots 143 are formed within slip section 142 that generally extend from uphole end 140*a* to coupling section 150. As shown in FIG. 2, slots 143 extend radially through slip section between radially outer surface 140*c* and through passage 144. However, referring briefly to FIGS. 2 and 4, in this embodiment, slots 143 are each undercut proximate to the intersection between tapered inner surface 146 and central cavity 148 such that a connecting member 141 is formed within each slot 143 that defines and separates each slot 143 into a first or uphole section 143*a* extending from uphole end 140*a* to connecting member 141 and a second or downhole section 143*b* that extends from connecting member 141 to coupling section 150. Thus, slots 143 separate slip section 142 into a plurality of collets or fingers 142*a* extending axially from coupling section 150 to uphole end 140*a*, that are connected by connecting members 141.

As best shown in FIG. 1, each of the collets 142*a* includes a plurality of buttons or teeth 152 that are embedded into radially outer surface 140*c*. Buttons 152 are formed of a relatively hard material such that buttons 152 may engage with and embed themselves within the inner surface of a wellbore tubular (e.g., a casing pipe) and thus help to fix the position of plug assembly 100 within the wellbore tubular during operations. For example, in some embodiments, buttons 152 may be formed from a polycrystalline diamond (PCD) material. Thus, each of the collets 142*a* form a slip that is radially extendable during operations (described in more detail below) to set or fix the position of the plug assembly within a wellbore tubular. The radial extension of collets 142*a* is initially prevented by connecting members 141 (see FIG. 4); however, when a sufficient radial load is exerted on collets 142*a*, connecting members 141 fail (e.g., fracture) to allow the radial expansion of collets 142*a*. In other embodiments, different types or designs of engagement teeth or profiles may be used on radially outer surface 140*c* for collets 142*a*. For example, in other embodiments, a wicker style thread profile (e.g., similar to the profiles included on surfaces 138, 146) may be used along outer surface 140*c* for collets 142*a*.

Referring specifically again to FIG. 2, coupling section 150 of slip sub 140 includes a recess 154 extending radially outward from cylindrical surface 149. Recess 154 is defined by a first downhole facing frustoconical surface 156, a second uphole facing frustoconical surface 159, and a cylindrical surface 157 extending axially between frustoconical surfaces 156, 159 that is radially spaced from cylindrical surface 149.

As best shown in FIG. 2, when ball seat 110, seal sub 120, and slip sub 140 are all coupled to one another, a central through passage 102 is formed through plug assembly 100 that extends between ends 100*a*, 100*b* and that is defined by throughbores 112, 122 of ball seat 110 and seal sub 120 and through passage 144 of slip sub 140. As a result, fluids flowing through a wellbore tubular (e.g., a casing pipe) may pass through plug assembly 100 via through passage 102 as long as passage 102 is not blocked or sealed (e.g., with a frac ball or other suitable valving member).

Figure 5:
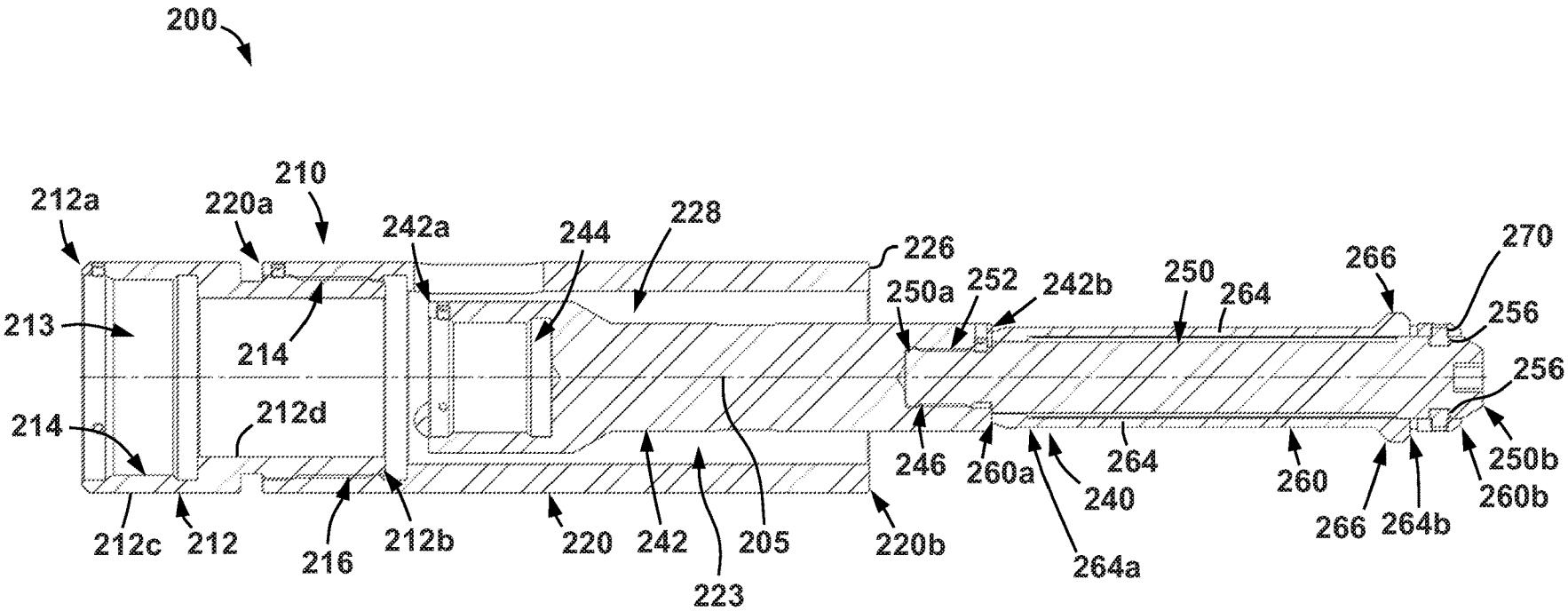
FIG. 5 is a side cross-sectional view of a setting tool adapter for use with embodiments of one or more of the plug assemblies disclosed herein.

Referring now to FIG. 5, a connection adapter 200 for coupling a setting tool (not shown) to plug assembly 100 is shown. Adapter 200 includes a central or longitudinal axis 205, an outer housing assembly 210, and an inner connection assembly 240 movably disposed within outer housing assembly 210.

Outer housing assembly 210 includes a first or upper housing member 212, and second or lower housing member 220 threadably engaged with upper housing member 212. Upper housing member 212 includes a first or uphole end 212*a*, a second or downhole end 212*b* opposite uphole end 212*a*, a radially outer surface 212*c* extending between ends 212*a*, 212*b*, and a radially inner surface 212*d* also extending between ends 212*a*, 212*b*. Radially inner surface 212*d* defines a throughbore 213 that extends axially between ends 212*a*, 212*b*. An upper connector 214 is disposed along radially inner surface 212*d* proximate uphole end 212*a*, and a lower connector 216 is disposed along radially outer surface 212*c* proximate downhole end 212*b*. In this embodiment, upper connector 214 comprises internal threads (not specifically shown) that engage with corresponding threads on a downhole end of a setting tool (not shown). Lower connector 216 includes a set of external threads (not specifically shown) that threadably engage with corresponding threads on an uphole end of lower housing member 220 (described in more detail below).

Lower housing member 220 includes a first or uphole end 220*a*, a second or downhole end 220*b* opposite uphole end 220*a*, a radially outer surfaces 220*c* extending between ends 220*a*, 220*b*, and a radially inner surface 220*d* also extending between ends 220*a*, 220*b*. Radially inner surface 220*d* defines a throughbore 223 that extends axially between ends 220*a*, 220*b*. An upper connector 224 is disposed along radially inner surface 220*d* proximate uphole end 220*a*, and a lower annular engagement surface 226 is disposed at downhole end 220*b*. Upper connector 224 comprises internal threads (not specifically shown) that engage with the external threads of lower connector 216 of upper housing member 212 to thereby coaxially secure housing members 212, 220 to one another along axis 205. As shown in FIG. 5, when upper housing member 212 is threadably connected to lower housing member 220, throughbores 213, 223 are joined to form a common inner throughbore 228 extending axially from uphole ends 212*a* of upper housing member 212 to downhole end 220*b* of lower housing member 220. It should be appreciated that in some embodiments, upper housing member 212 and lower housing member 220 are formed of a single, integral outer housing.

Referring still to FIG. 5, inner connection assembly 240 includes an upper connection member 242, a lower connection member 250, and a collet sleeve 260 disposed about and mounted to lower connection member 250. Upper connection member 242 includes a first or uphole end 242*a*, a second or downhole end 242*b* opposite uphole end 242*a*, and a radially outer surfaces 242*c* extending between ends 242*a*, 242*b*. An upper connection receptacle 244 extends axially inward to upper connection member 242 from uphole end 242*a* and a lower connection receptacle 246 extends axially inward to upper connection member 242 from downhole end 242*b*. Upper connection member 242 includes a set of internal threads (not specifically shown) that are configured to engage with corresponding external threads on an inner member (not shown) of setting tool (not shown) during operations. Lower connection receptacle 246 includes a set of internal threads (not specifically shown) that engage with a corresponding set of external threads that are disposed along a radially outer surface of lower connection member 250 (described in more detail below).

Figure 6:
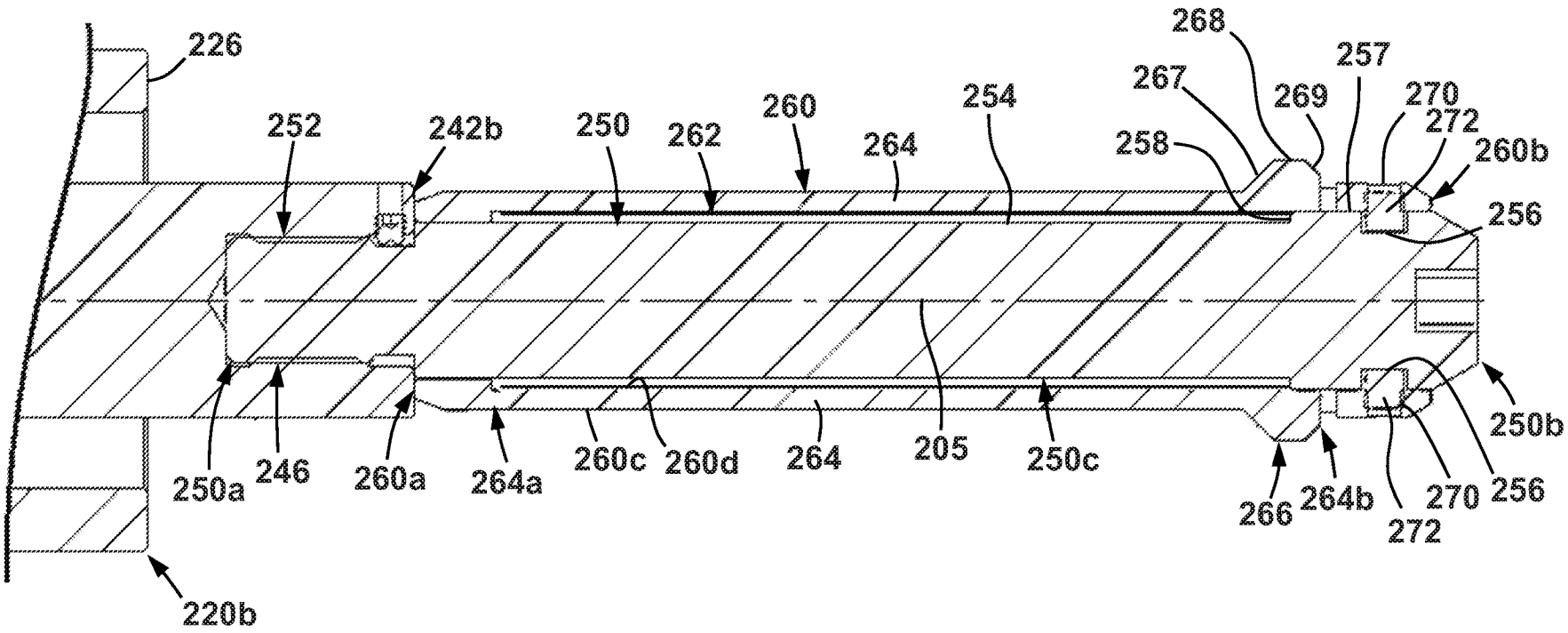
FIG. 6 is an enlarged side cross-sectional view of the inner connection assembly of the setting tool adapter of FIG. 5.

Referring now to FIGS. 5 and 6, lower connection member 250 includes a first or uphole end 250*a*, a second or downhole end 250*b* opposite uphole end 250*a*, and a radially outer surfaces 250*c* extending between ends 250*a*, 250*b*. As is best shown in FIG. 6, radially outer surface 250*c* includes an upper connector 252 extending from uphole end 250*a*, a first or upper cylindrical surface 254 extending axially from upper connector 252 to a radially extending shoulder 258, and a second or lower cylindrical surface 257 extending from shoulder 258 toward downhole end 250*b*. Lower cylindrical surface 257 is radially spaced outward from upper cylindrical surface 254, and thus, shoulder 258 extends radially outward from axis 205 from upper cylindrical surface 254 to lower cylindrical surface 257. Upper connector 252 includes a set of external threads (not specifically shown) that correspond and engage with the internal threads in lower connection receptacle 246 of upper connection member 242. A plurality of recesses 256 extend radially inward from lower cylindrical surface 257. In this embodiment, there are a total of four recesses 256 (only two recesses 256 are shown in the cross-section of FIG. 5) that are evenly circumferentially spaced about axis 205.

Referring still to FIGS. 5 and 6, collet sleeve 260 is a generally tubular member that is disposed about lower connection member 250. In particular, collet sleeve 260 includes a first or uphole end 260*a*, a second or downhole end 260*b* opposite uphole end 260*a*, a radially outer surface 260*c* extending between ends, and a radially inner surface 260*d* also extending between ends 260*d*. Radially inner surfaces 260*d* defines a throughbore 262 that receives lower connection member 250 therethrough during operations. A plurality of radially extending apertures are formed through collet sleeve 260, between surfaces 260*c*, 260*d*, that define a plurality of axially extending collets or fingers 264. Each collet 264 includes an fixed end 264*a* that is proximate uphole end 260*a* of sleeve 260 (i.e., fixed end 264*a* is more proximate uphole end 260*a* than downhole end 260*b*), a free end 264*b* that is proximate downhole end 260*b* of sleeve 260 (i.e., free end 264*b* is more proximate downhole end 260*b* than uphole end 260*a*), and an engagement projection 266 disposed at free end 264*b*. Engagement projection 266 comprises an uphole facing frustoconical surface 267, a downhole facing frustoconical surface 269, and a cylindrical surface 268 extending axially between frustoconical surfaces 267, 269.

Further, sleeve 260 also includes a plurality of radially extending bores 270 axially disposed between free ends 264*b* of collets 264 and downhole end 260*b* of sleeve 260. Bores 270 are evenly circumferentially spaced about axis 205. In addition, in when sleeve 260 is disposed about lower connection member 250 as shown in FIG. 5, bores 270 each circumferentially align with one of the recesses 256, and a plurality of shear pins 272 are inserted through the aligned 270 and recesses 256 to thereby fix the initial relative axial and circumferential positions of lower connection member 250 and sleeve 260 during operations. Thus, in this embodiment, sleeve 260 includes a total of four evenly, circumferentially spaced bores 270 (only two bores 270 are shown in the cross-section of FIG. 5).

In addition, as is best shown in FIG. 6, when collet sleeve 260 is axially and circumferentially fixed to lower connection member 250 via shear pins 272 as previously described, free ends 264*b* of collets 264 engage with lower cylindrical surface 257 and are therefore prevented from deflecting radially inward toward axis 205.

Figure 7:
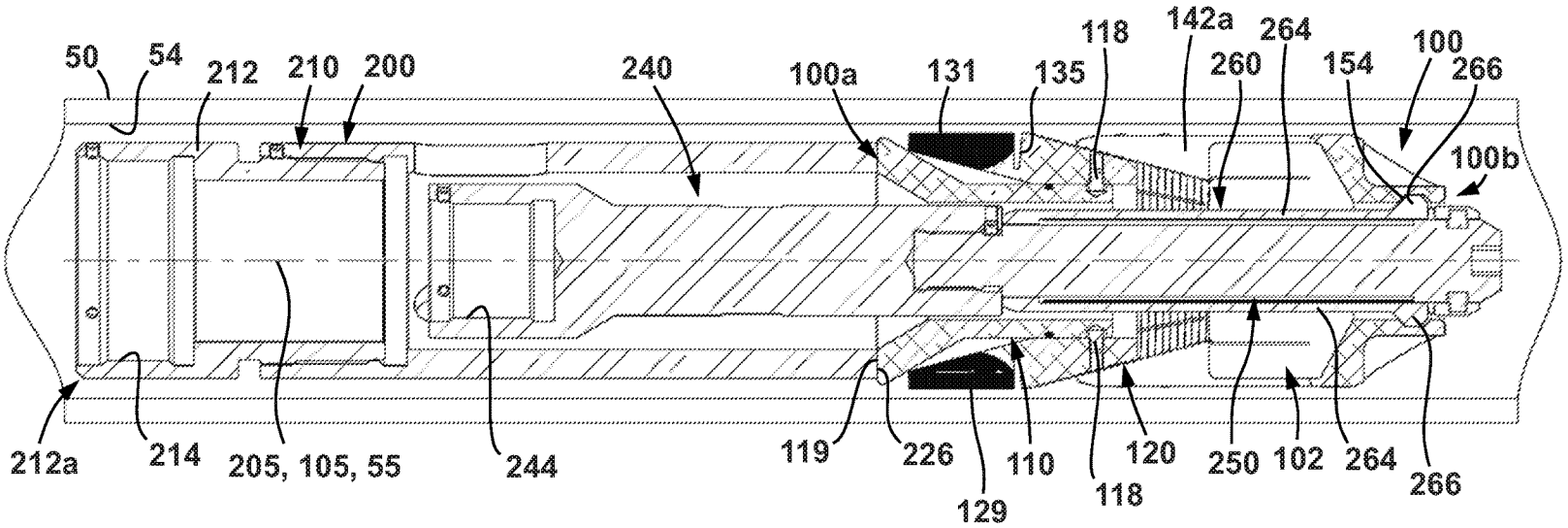
FIGS. 7-10 are sequential side cross-sectional views of an installation sequence of the plug assembly of FIG. 1 within a wellbore tubular.

Referring now to FIG. 7, when installing plug assembly 100 within a wellbore tubular (e.g., a casing pipe), plug assembly 100 is first coupled to an end of a setting tool (not shown) via the adapter 200. In particular, lower connection member 250 (with collet sleeve 260 disposed thereabout) is inserted within central through passage 102 of assembly 100 so that engagement projections 266 on collets 264 are received within recess 154 of slip sub 140. In addition, when inner connection member 250 and sleeve 260 are received within through passage 102 of plug assembly 100, annular engagement surface 226 of outer housing assembly 210 engages or abuts with annular engagement surface 119 on ball seat 110.

Further, while not specifically shown, adapter 200 is also coupled to a setting tool. In particular, upper connector 214 and upper connection receptacle 244 of outer housing assembly 210 and inner connection assembly 240 are engaged (e.g., threadably engaged) with suitable connectors on the downhole end of the setting tool (not shown) and setting tool, adapter 200, and plug assembly 100 are then inserted within the wellbore tubular, which is depicted in FIG. 7 as a casing pipe (or casing) 50. For illustration and descriptive purposes, adapter 200, and plug assembly 100 are depicted in FIG. 7 such that axes 205 and 105 of adapter 205 and plug assembly 100, respectively, are aligned with the central axis 55 of casing 50; however, such precise alignment is not required.

Figure 8:
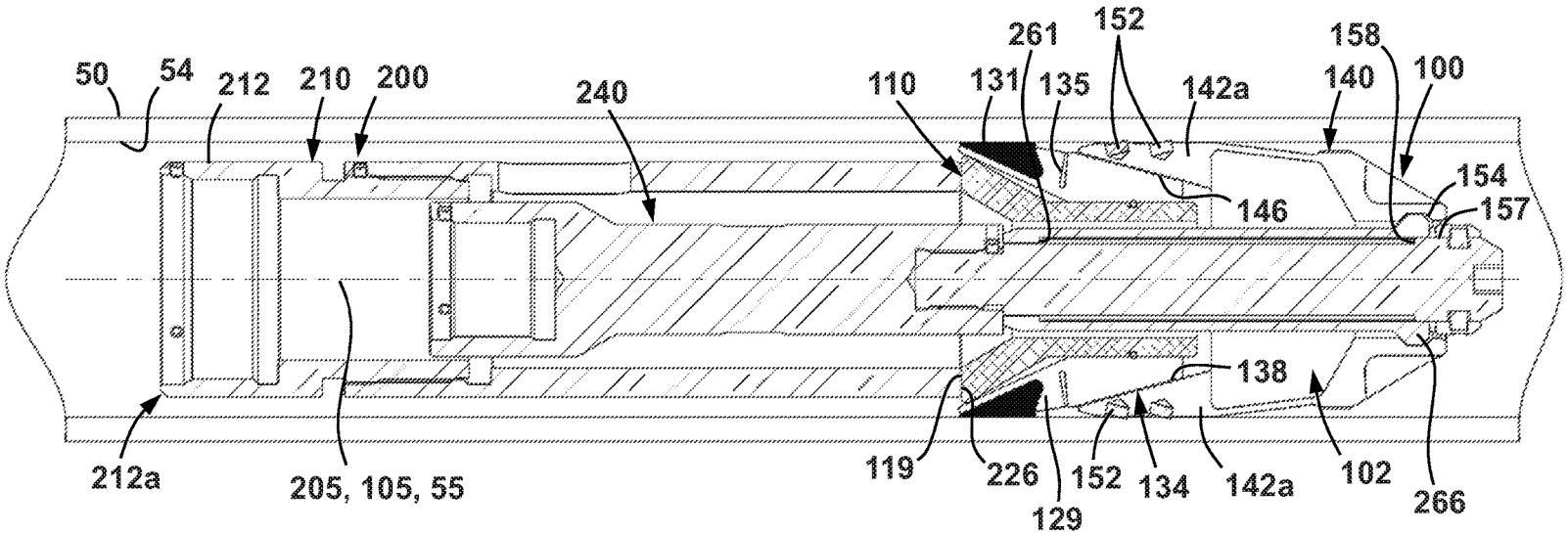

Referring now to FIGS. 7 and 8, once plug assembly 100 is installed within casing 50 on adapter 200 as shown, and plug assembly 100 has been advanced to the desired axial position within casing 50, setting tool (not shown) is actuated to force inner connection assembly 240 axially uphole or toward uphole end 212*a* of upper housing member 212. The setting tool (not shown) may use any suitable actuation method (e.g., hydraulic pressure, explosive charges, mechanical systems, pneumatic systems, etc.) to axially actuate inner connection assembly relative to outer housing assembly 210. Specifically, the setting tool may actuate assemblies 210, 240 of adapter 200 by forcing inner connection assembly 240 axially uphole within outer housing assembly 210, by forcing outer housing assembly 210 axially downhole over inner connection assembly 240, or both.

Regardless of the specific actuation method used by setting tool (not shown), as shown in the progression from FIG. 7 to FIG. 8, as inner connection assembly 240 is forced axially uphole into outer housing assembly 210, plug assembly 100 is axially compressed due to the engagement between lower annular engagement surface 226 on outer housing assembly 210 and annular engagement surface 119 at uphole end 100*a* of plug assembly 100 and the engagement between engagement projections 266 on collets 264 and recess 154 within through passage 144 of slip sub 140 proximate downhole end 100*b* of plug assembly 100. As a result of this axial compression, slip sub 140 is forced axially toward ball seat 110 and seal sub 120 such that inner tapered surface 146 slidingly advances over outer tapered surface 138 and radial shoulders 147 formed on outer tapered surface 146 progressively ratchet past corresponding ones of the radial shoulders 137 on inner tapered surface 138 (see engagement between shoulders 137, 147 in FIG. 2). In addition, as inner tapered surface 146 is forced over inner tapered surface 138 (or inner tapered surface 138 is forced into outer tapered surface 146), the taper of surfaces 138, 146 facilitate a radially outwardly directed (i.e., away from axis 105) load that is transferred to collets 142*a*. Initially, radial deformation of collets 142*a* is prevented by connecting members 141 disposed within slots 143 (see FIGS. 2 and 4); however, as slip sub 140 continues to be forced axially over coupling section 134 of seal sub 120, the radially outward directed load on collets 142*a* increases such that connecting members 141 (or at least some of the connecting members 141) fail (e.g., fracture) therefore allowing collets 142*a* to radially expand toward an inner surface or wall 54 of casing 50. The radial expansion of collets 142*a* also causes buttons 152 to embed themselves within inner wall 54 to therefore fix the axial position of plug assembly 100 within casing 50.

Referring still to FIGS. 7 and 8, following the initial expansion of collets 142*a*, continued axial compression of plug assembly 100 eventually fractures shear pins 118 extending between ball seat 110 and seal sub 120 so that seal sub 120 is forced axially uphole and over ball seat 110 (or ball seat 110 is forced axially downhole and within seal sub 120). As slip sub 120 is forced axially uphole and over ball seat 110, frustoconical surfaces 114, 124 slidingly engage one another thereby imparting a radially outwardly directed load to collets 129. As a result of this radially outwardly directed load, collets 129 expand radially outward and therefore force sealing element 131 into sealing engagement with inner wall 54 of casing 50. Thereafter, fluid communication within casing 50 between inner wall 54 and plug assembly 100 is prevented (or at least restricted). This radial expansion of collets 129 is facilitated by circumferential groove 135 due to the reduced wall thickness in seal sub 120 at groove 135. In addition, the absence of material within groove 135 creates space that further facilitates the movement and deflection of collets 129 previously described. In this embodiment, shear pins 118 are configured such that they fail after connecting members 141 between collets 142*a*. Therefore, in this embodiments, collets 142*a* radially expand before sealing element 131 is radially expanded. Further, the mismatched taper angles (i.e., angles θ, β shown in FIG. 2) of frustoconical surfaces 114, 124 allow for a relatively small axial movement of ball seat 110 within seal sub 120 to result in a desired radial expansion of collets 129.

Figure 9:
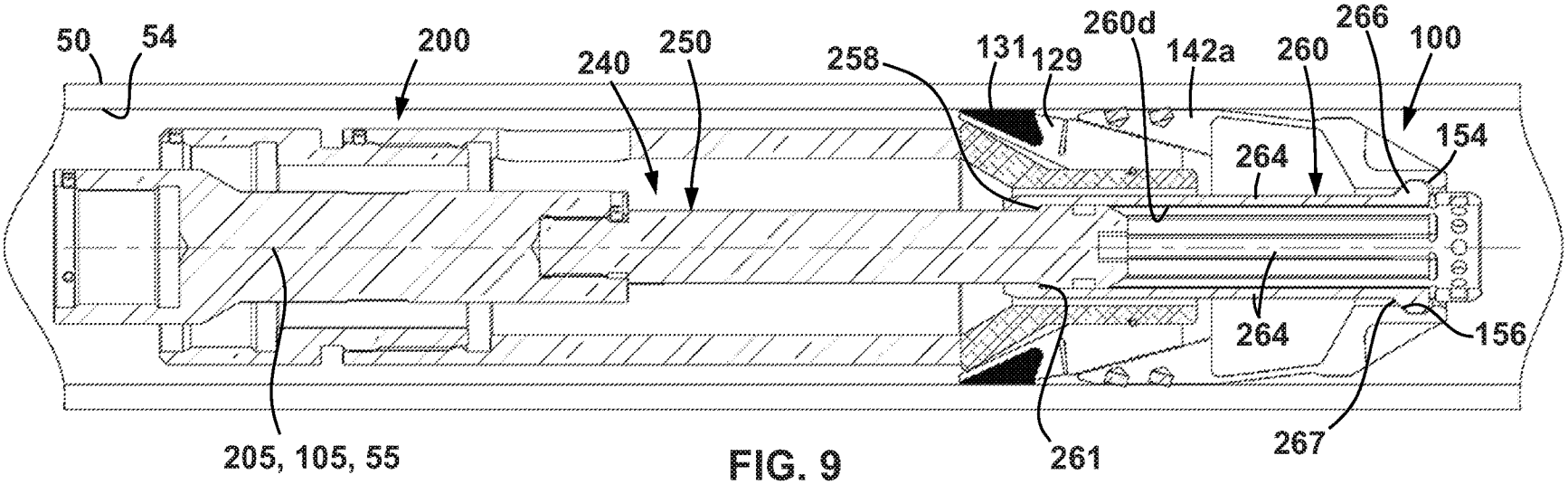

Referring now to FIGS. 8 and 9, following the radial explanation of both collets 142*a* on slip sub 140 and collets 129 on seal sub 120, continued axial loads imparted on inner connection assembly 240 by the setting tool (not shown) eventually cause shear pins 272 extending between collet sleeve 260 and lower connection member 250 to fail (e.g., shear) so that inner connection member 250 translates axially uphole relative to both collet sleeve 260 and plug assembly 100 until shoulder 258 engages with a radially extending shoulder 261 formed along radially inner surface 260*d* of collet sleeve 260. At this point, collet sleeve 260 is prevented from axially translating uphole within plug assembly 100 due to the engagement between upward facing frustoconical surfaces 267 on engagement projections 266 and downward facing frustoconical surface 156 in recess 154. As a result axially compressive loads are still imparted to plug assembly 100 after actuation of lower connection member 250 that may cause additional axial compression of plug assembly 100 (and thus potentially further radial expansion of collets 142*a*, 129 as previously described).

Figure 10:
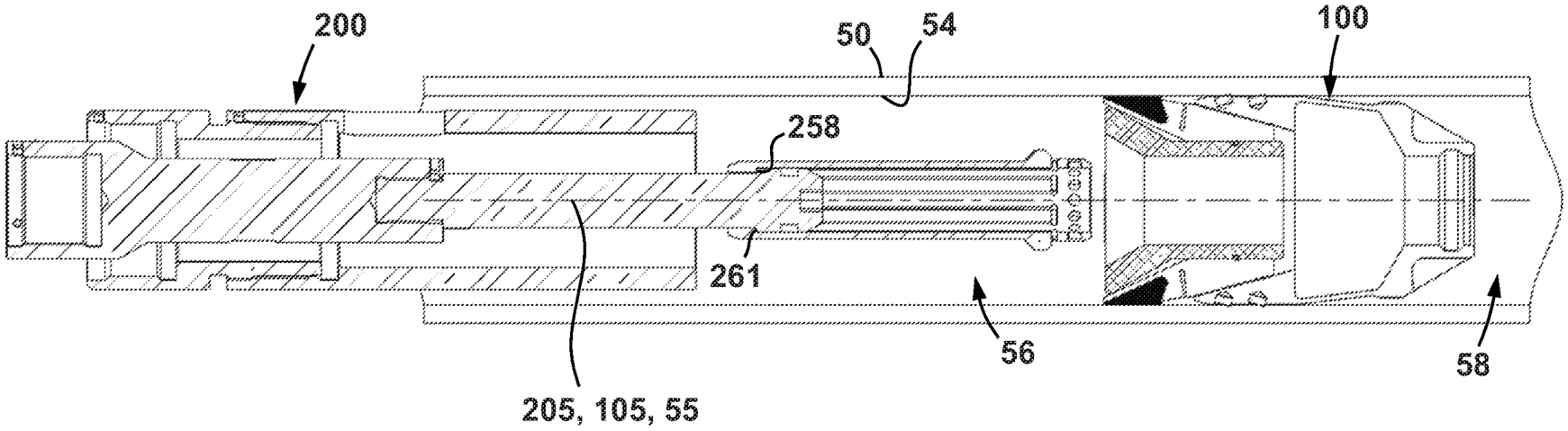

Referring now to FIG. 10, following the failure of shear pins 272 and axial translation of lower connection member 250 within collet sleeve 260 as described above, continued axial loads are placed on collet sleeve 260 by the setting tool (not shown) via the engagement between shoulders 258, 261, previously described above. Due to the orientation of the engaged frustoconical surfaces 267, 256, this continued axial load imparts a radially inwardly directed load on collets 264. Prior to translation of lower connection member 250 within collet sleeve 260, collets 264 were prevented from deflecting radially inward toward axis 205 due to the engagement between collets 264 and lower cylindrical surface 257 on lower connection member 250 (see FIG. 8). However, once lower connection member 250 has translated axially uphole within collet sleeve 260 as previously described, collets 264 are then free to deflect radially inwardly toward axes 205, 105 under the radial load imparted by the engagement between frustoconical surfaces 267, 156. As a result, the continued axial load placed on collet sleeve 260 eventually causes engagement projections 266 to disengage from recess 154 so that collet sleeve 260 is then free to advance axially uphole out of plug assembly 100. Thereafter, the setting tool (not shown) and adapter 200 are retrieved to the surface, thereby leaving the actuated plug assembly 100 within casing 50 as shown. At this point, fluids within casing 50 are prevented from flowing across plug assembly 100 in the radial space between inner wall 54 and plug assembly 100 by the sealing engagement between inner wall 54 and sealing element 131. However, the inner through passage 102 of plug assembly 100 remains open so that fluids may pass freely therethrough.

Referring still to FIG. 10, eventually it may be come desirable to seal a section of casing 50 that is uphole from plug assembly 100 (i.e., an uphole section 56) from the section of casing 50 that is downhole of plug assembly 100 (i.e., a downhole section 58). For example, during a hydraulic fracturing operation, it may be desirable to pressurize uphole section 56 relative to downhole section 58 to thereby force proppant (e.g., sand) through perforations (not shown) in the casing 50 and into the surrounding subterranean formation in order to open up cracks or fissures therein that provide a path for hydrocarbons within the formation to flow back into casing 50 and be produced to the surface.

Figure 11:
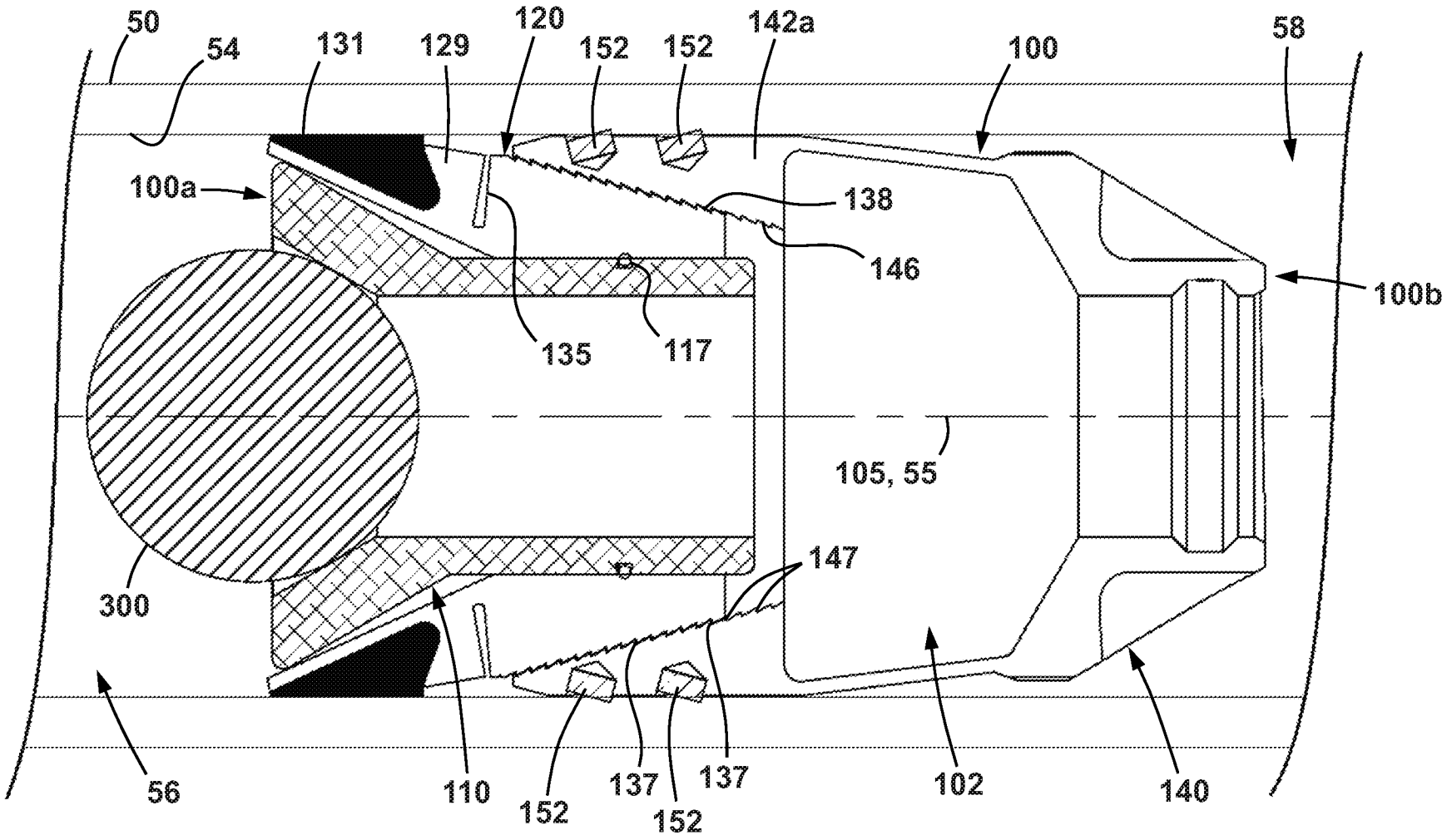
FIG. 11 is side cross-sectional view of the plug assembly of FIG. 1 installed within a wellbore tubular, and with a ball landed thereon.

Referring now to FIG. 11, to effect a sealed fluid barrier between sections 56, 58 of casing 50 following the initial installation of plug assembly 100 therein, a ball (or dart or any other suitable flowable plugging member as previously described) 300 is pumped from the surface into the casing 50 until it lands on frustoconical surface 111 of ball seat 110. The engagement between ball 300 and frustoconical surface creates an additional seal that prevents fluids within casing 50 from flowing through central through passage 102 of plug assembly 100. In addition, fluids are prevented from migrating between ball seat 110 and seal sub 120 due to the seal created by sealing ring 117 disposed between ball set 110 and seal sub 120. After ball 300 is landed and through passage 102 is sealed as described above, uphole section 56 of casing is pressurized (e.g., to 10,000 psi or more in some embodiments), which further urges ball 300 into engagement with seat 110. Because buttons 152 on collets 142*a* of slip sub 140 are embedded within inner wall 54, the axial load imparted on ball seat 110 by ball 300 may cause additional axial compression of plug assembly 100 which imparts additional radially outwardly directed loads to both collets 129 on seal sub 120 and collets 142*a* of slip sub 140 as previously described. As seal sub 120 is axially advanced farther into slip sub 140 due to the loads imparted by ball 300 as previously described, shoulders 137 on outer tapered surface progressively ratchet further past corresponding shoulders 147 of inner tapered surface 146. As a result, when the pressure within uphole section 56 is reduced (and the axially compressive loads on plug assembly 100 are removed), seal sub 120 is prevented from axially withdrawing from slip sub 140 due to engagement between the corresponding shoulders 137, 147.

Following these operations, it may no longer become necessary to seal off sections 56, 58 of casing from one another with plug assembly 100. As a result, plug assembly 100 may be removed from casing 50 following the above described pressurization operations. In some embodiments, plug assembly 100 may be milled with a drill or milling bit that is inserted and rotated within casing on the end of a tubular string. In other embodiments, most (or all) of the components of plug assembly 100 are constructed from a dissolvable material (e.g., a dissolvable alloy) that dissolves as a result of contact with the fluids disposed within casing 50. For example, in some specific embodiments, all components of plug assembly 100 are constructed from one or more such dissolvable alloys, with the exception of buttons 152. In these embodiments, the dissolvable materials making up plug assembly 100 may be selected and engineered to dissolve after a sufficient amount of time has elapsed (e.g., a sufficient amount of time to allow for the installation of plug assembly 100 within casing 50 and to carry out the desired pressurization operations described above). As a result, following the cessation of pressurization operations (e.g., such for performing hydraulic fracturing of the subterranean formation), the flow path defined by casing may be once again fully open or substantially unobstructed by plug assembly 100, such that production of the wellbore may commence thereafter.

Figure 12:
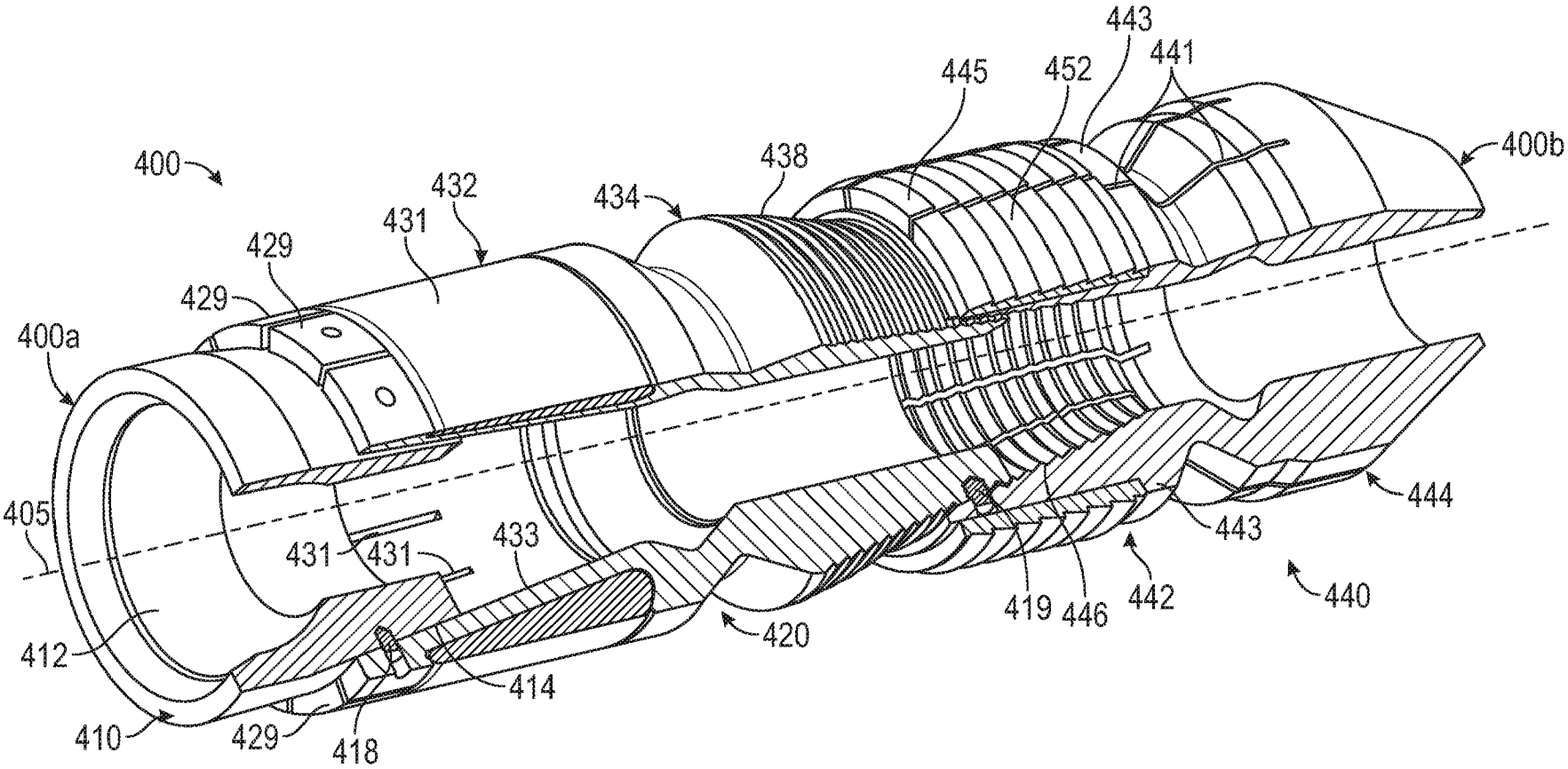
FIG. 12 is a perspective, quarter sectional view of a plug assembly for use within a subterranean wellbore tubular according to some embodiments.

Referring now to FIG. 12, another embodiment of a plug assembly 400 for use in place of plug assembly 100 is shown. Plug assembly 100 is similar to plug assembly 100, previously described, and thus, like components are not described in detail herein in the interest of brevity.

As shown in FIG. 12, plug assembly includes a central or longitudinal axis 405, a first or uphole end 400*a*, a second or downhole end 400*b* opposite uphole end 400*a*, a ball seat 410, a seal sub 420, and a slip sub 440. Ball seat 410 includes a ball landing surface 412 and a frustoconical outer surface 414. Seal sub 420 includes a sealing portion or section 432 and a coupling portion or section 434. Sealing section 432 includes a frustoconical inner surface 433 and a sealing element 431 bonded thereto. A plurality of axially extending slots 431 extend through sealing section 431 that thereby define and form a plurality of axially extending collets or fingers 429 (where sealing element 431 is bonded to and between collets 429). Ball seat 410 is received within coupling section 432 of seal sub 420 such that frustoconical outer surface 414 engages with frustoconical inner surface 414 and a plurality of shear pins 418 are inserted through collets 429 and into ball seat 410 such that an axial and circumferential position of ball seat 410 is initially fixed within seal sub 120.

Coupling section 434 of seal sub 420 includes an tapered outer surface 438 carrying a wicker style thread profile which is similar to the thread profile carried on tapered outer surface 138 of seal sub 120, previously described.

Referring still to FIG. 12, slip sub 440 includes a slip portion or section 442 and a coupling section or portion 444. Slip section 442 includes a plurality of axially extending slots 441 that define a plurality of axially extending collets or fingers 443. A slip member 452 is coupled to each of the collets 443 that comprises a wicker style slip profile that is similar to the wicker style thread profiles discussed above on surfaces 138, 146 of plug assembly 100. In addition, slip section 442 includes a tapered inner surface 446 that carries a wicker thread profile which is similar to the thread profile carried on tapered inner surface 146 of slip sub 140. Coupling section 434 of seal sub 440 is received within slip section 442 of slip sub 440 such that the wicker style thread profile on tapered outer surface 438 engages with the wicker style thread profile on tapered inner surface 446 in the same manner that the profiles engage one another on surfaces 138, 146 in plug assembly 100. A plurality of shear pins 419 are inserted through each of the collets 443 and into tapered outer surface 438 on seal sub 420 so that an axial and circumferential position of seal sub 420 is initially fixed within slip sub 440.

During operations with plug assembly 400, collets 443 carrying slip members 452 are radially expanded into contact with an inner wall of a wellbore tubular (e.g., inner wall 54 of casing 50 shown in FIGS. 7-10) by axially advancing coupling section 434 of seal sub 420 within slip section 442 of slip section 440 (or axially advancing slip section 442 of slip sub 440 over coupling section 434 of seal sub 420) to impart a radially outwardly directed load from the contact between tapered surfaces 428, 446 that expands collets 443 and slip members 452 radially outward. Initial radial expansion of collets 443 may be prevented until shear pins 419 fail as a result of a sufficient, desired axial compression that is applied to plug assembly 400 (e.g., by a setting tool). In addition, as shown in FIG. 12, slip members 452 may initially be interconnected by connecting members 445, and radial expansion of collets 443 may further be prevented until a sufficient radial load is imparted on collets 443 (e.g., by the contact between tapered outer surface 438 and tapered inner surface 446) to fracture some or all of the connecting members 445 and therefore allow the radial expansion of collets 443. Subsequent axial withdrawal of seal sub 420 from slip sub 440 may be prevented by the engagement between the corresponding wicker style threads carried on tapered surfaces 438, 446 in the same manner as described above for surfaces 138, 146 on plug assembly 100.

After collets 443 are radially expanded as previously described, continued axial compression of plug assembly 400 causes seal member 431 to radially expand into sealing contact with the inner wall of the wellbore tubular. Specifically, ball seat 410 is axially advanced within seal section 432 of seal sub 420 such that frustoconical surfaces 424, 433 slidingly engage with one another to imparting a radially outwardly directed load to collets 429. Initial advancement of ball seat 410 within seal sub 420 is prevented until a sufficient axially compressive load is imparted on plug assembly 400 (e.g., by a setting tool) to fracture shear pins 418. In this embodiment, shear pins 418 are configured to fail after shear pins 419 and connecting members 445 so that sealing member 431 is radially expanded after collets 443.

Subsequent to initial expansion of collets 443 and 429 a ball (e.g., ball 300) may be pumped in to the wellbore to land on surface 412 and thus seal off the wellbore tubular in a similar manner to that described above for plug assembly 100. In addition, the application of pressure uphole of plug assembly 400 following the landing of a ball on seat 410 may impart further axially compressive loads to plug assembly 400 in the same manner as described above for plug assembly 100.

Figure 13:
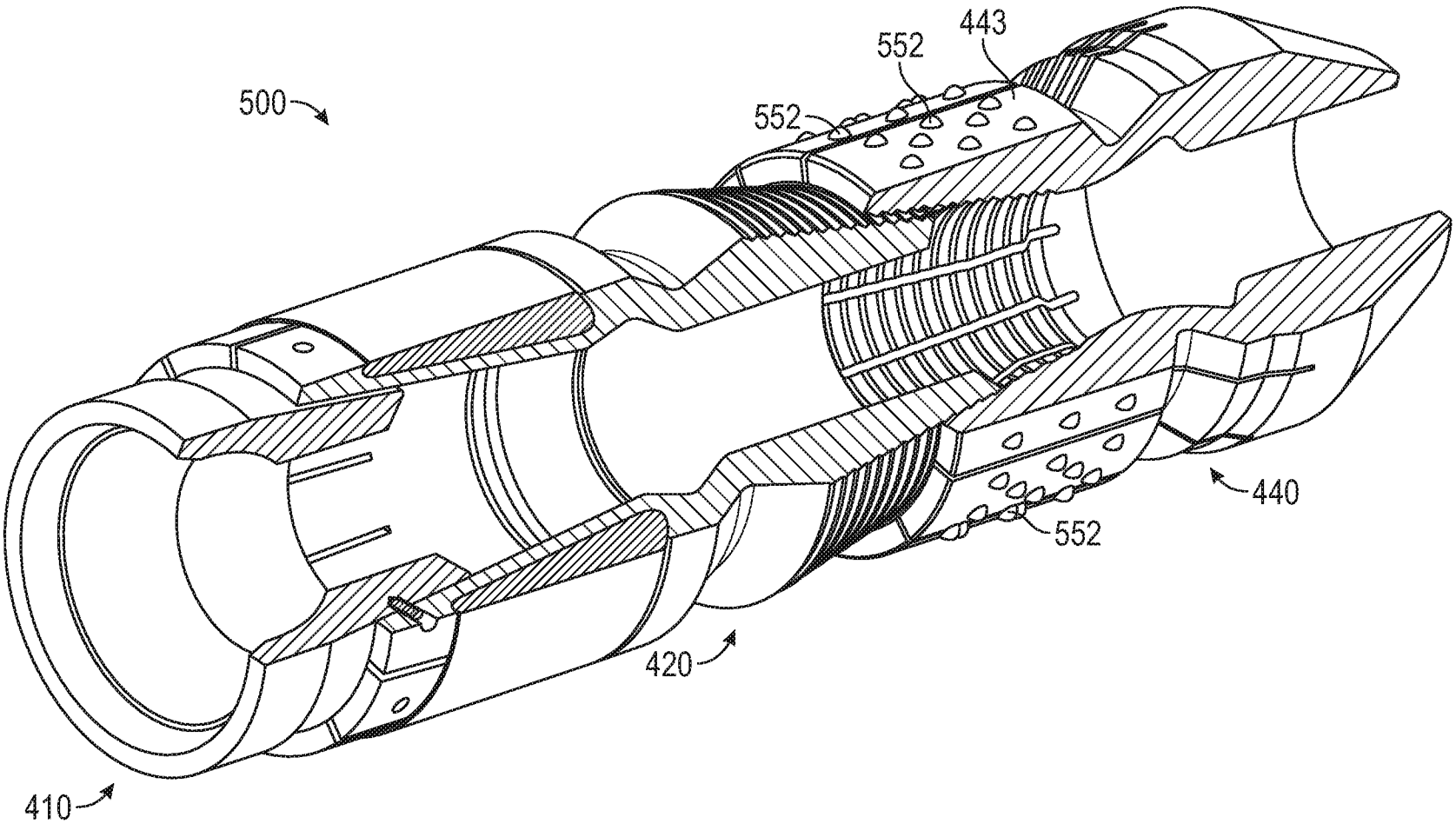
FIG. 13 is a perspective, quarter sectional view of a plug assembly for use within a subterranean wellbore tubular according to some embodiments.

Referring now to FIG. 13, another embodiment of plug assembly 500 is shown. Plug assembly 500 is generally the same as plug assembly 400, and thus, similar features are identified with the same reference numerals, and the description below will focus on the components and features of plug assembly 500 that are different from plug assembly. In particular, as shown in FIG. 13, all features of plug assembly 500 are the same as for plug assembly 400 except that slip members 452 are removed and are replaced with a plurality of buttons 552 embedded within collets 443. Buttons 552 may be the same or similar to the buttons 152 previously described for use with plug assembly 100. Operations with plug assembly 500 are essentially the same as described above for plug assembly 400, except that buttons 552 rather than wicker style slip members 452 are engaged with the inner wall of the wellbore tubular (e.g., inner wall 54 of casing shown in FIGS. 7-10).

Figure 14:
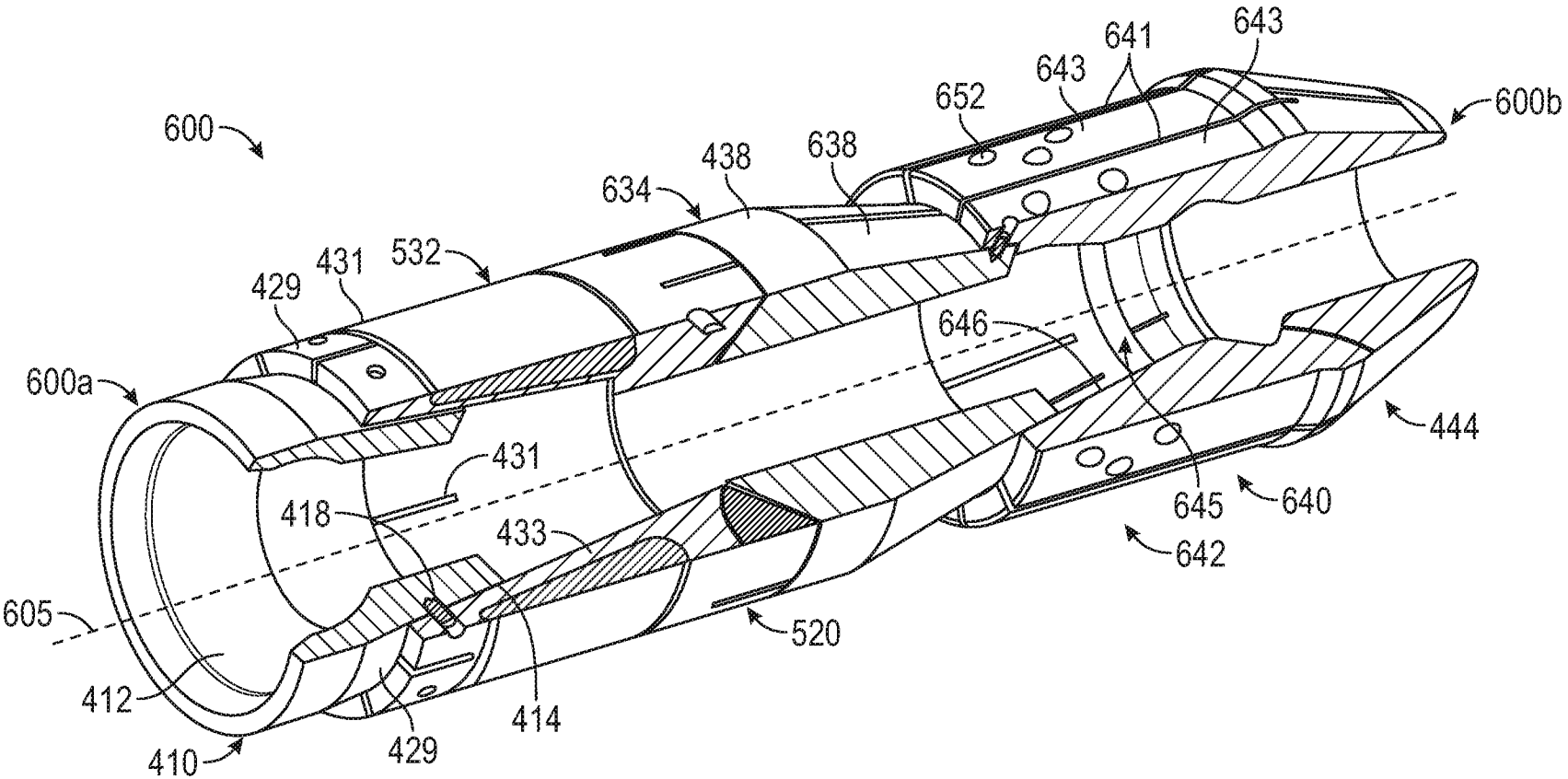
FIG. 14 is a perspective, quarter sectional view of a plug assembly for use within a subterranean wellbore tubular according to some embodiments.

Referring now to FIG. 14, another embodiment of a plug assembly 600 is shown. Plug assembly 600 is similar to plug assembly 400, and thus, like features are identified with the same reference numerals, and the discussion below will focus on the components and features of plug assembly 600 that are different from plug assembly 400.

In particular, plug assembly 600 includes a central or longitudinal axis 605, a first or uphole end 600*a*, a second or downhole end 600*b* opposite uphole end 600*a*, ball seat 410 (previously described), a seal sub 620, and a slip sub 640. Seal sub 620 includes a seal section 632 that is the same as seal section 432 of seal sub 420 on plug assembly 400, and a coupling section 634. Coupling section 634 includes a frustoconical outer surface 638 that tapers radially inward toward axis 605 when moving axially toward downhole end 600*b*.

Referring still to FIG. 14, slip sub 640 includes a slip portion or section 642 and the coupling section 444 from slip sub 440. Slip section 642 includes an frustoconical inner surface 646 that tapers radially inward toward axis 605 when moving toward downhole end 600*b*. In addition, slip section 642 includes a plurality of axially extending slots 641 that separate slip section 642 into a plurality of axially extending collets or fingers 643. Each collet 643 includes a plurality of buttons 652 embedded therein that may be similar to buttons 152 previously described for plug assembly 100.

During operations, plug assembly 600 is axially compressed (e.g., by a setting tool) to radially expand seal members 431 into sealing engagement with an inner wall of a wellbore tubular (e.g., casing 50 shown in FIGS. 7-10) in the same manner as described above for plug assembly 400. In addition, axial compression of plug assembly 600 also results in the redial expansion of collets 643 into engagement with the inner wall of the wellbore tubular to thereby fix an axial position of plug assembly 600 therein. In particular, during these operations, slip section 642 of slip sub 640 is forced axially over coupling section 634 of seal sub 120 (or coupling section 634 is forced axially into slip section 642 of slip section 640) such that frustoconical surfaces 638, 646 slidingly engage with one another. The sliding engagement between surfaces 638, 646 imparts a radially outwardly directed load on collets 643 such that collets 643 are radially expanded to being buttons 652 into contact with the inner wall of the wellbore tubular. Initial radial expansion of collets 643 may be resisted by connecting members 645 disposed within slots 641, which are similar to connecting members 141 described above for plug assembly 100. As a result, during axial compression of plug assembly 600, radial expansion of collets 643 is prevented (or at least resisted) until one or more of the connecting members 645 are fractured. As with plug assembly 400, shear pins 418 may be configured to fail after connecting members 645 so that sealing element 431 is radially expanded after collets 643.

For each of the embodiments of FIGS. 12-14, once plugs 400, 500, 600 are no longer needed within the wellbore tubular (e.g., casing 50), each may either be milled out of the tubular or may be constructed of dissolvable materials so that they may mostly (or completely) dissolve away in a similar manner to that described above for plug assembly 100.

Figure 15:
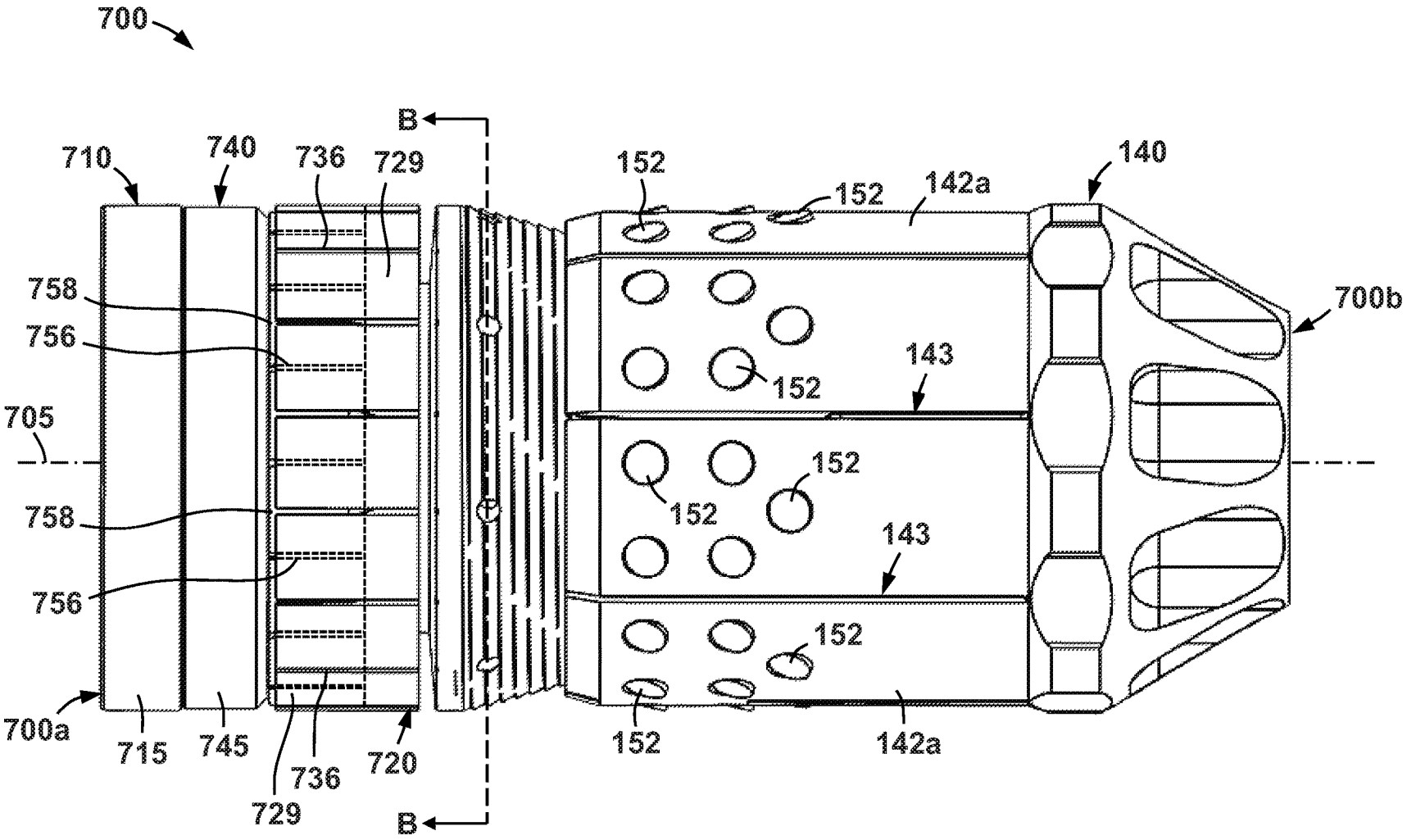
FIG. 15 is a side view of a plug assembly for use within a subterranean wellbore tubular according to some embodiments.
Figure 16:
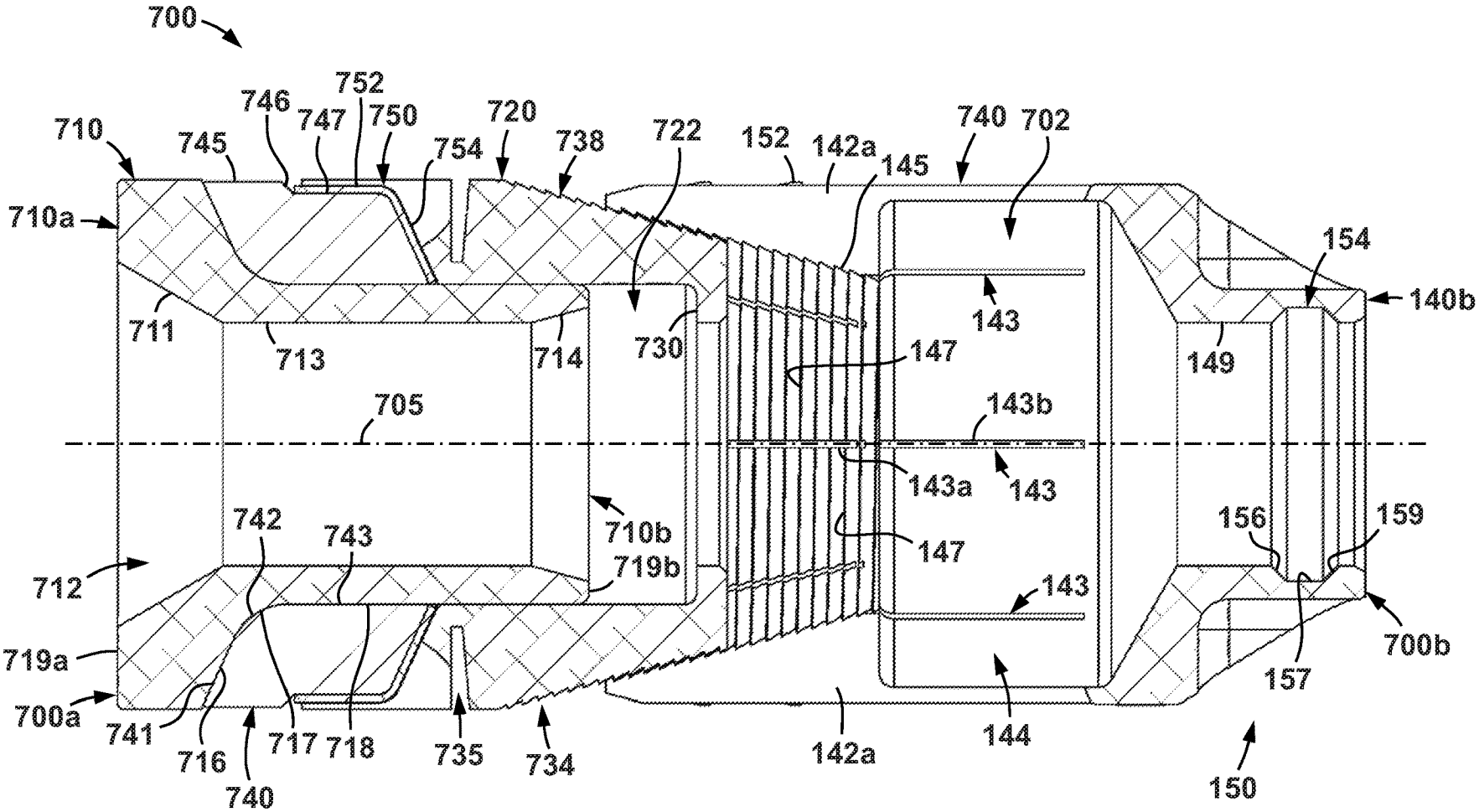
FIG. 16 is a side cross-sectional view of the plug assembly of FIG. 15.

Referring now to FIGS. 15 and 16, an embodiment of a plug assembly 700 for use within a subterranean wellbore tubular is shown. In some embodiments, plug assembly 700 may be used as a frac plug. Plug assembly 700 generally includes a central or longitudinal axis 705, a first or uphole end 700*a*, and a second or downhole end 700*b* opposite uphole end 700*a* along axis 705. In addition, plug assembly 700 generally includes a ball seat 710, slip sub 140, a seal sub 720, a sealing element 740, and a support ring 750. Ball seat 710 extends from uphole end 700*a*, slip sub 140 extends from downhole end 700*b*, and each of the sealing element 740, support ring 750, and seal sub 720 are coupled and extend between the ball seat 710 and slip sub 140. Slip sub 140 is generally the same as the seal sub 140 of plug assembly 100 of FIG. 1, and thus, this component is not described in detail again in the interest of brevity.

Figure 17:
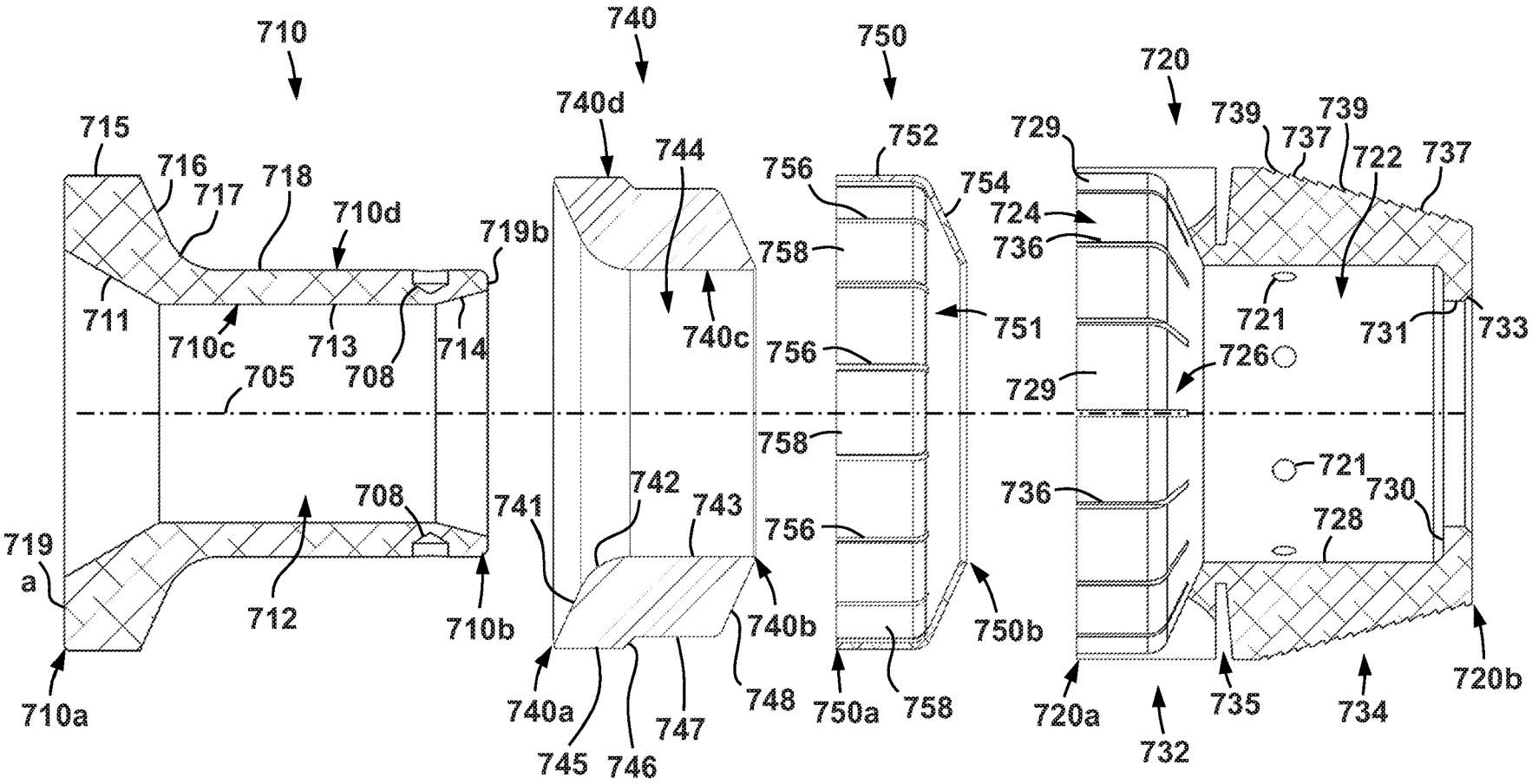
FIG. 17 is a side, exploded cross-sectional view of a portion of the plug assembly of FIG. 15.

Referring now to FIGS. 16 and 17, ball seat 710 is a generally tubular member that includes a first or uphole end 710*a*, a second or downhole end 710*b* opposite uphole end 710*a*, a radially inner surface 710*c* extending between ends 710*a*, 710*b*, and a radially outer surface 710*d* also extending between ends 710*a*, 710*b*. When plug assembly 700 is undeployed (that is plug assembly 700 is not sealingly engaged within a subterranean wellbore), uphole end 710*a* is coincident with uphole end 700*a* of plug assembly 700. In addition, uphole end 710*a* of seat 710 defines an uphole annular engagement surface 719*a* that engages with a corresponding surface on a setting tool adapter (e.g., setting tool adapter 200). Further, downhole end 710*b* of seat 710 defines a downhole annular engagement surface 719*b* that engages with a corresponding shoulder (e.g., shoulder 730) defined within seal sub 720 as described in more detail below.

Radially inner surface 710*c* defines a throughbore 712 extending axially between ends 710*a*, 710*b* that includes a frustoconical landing surface 711 extending from uphole engagement surface 719*a*, a cylindrical surface 713 extending axially from frustoconical surface 711, and a frustoconical surface 714 extending from cylindrical surface 713 to downhole annular engagement surface 719*b*. Frustoconical surface 711 tapers radially inward toward axis 705 when moving axially from uphole engagement surface 719*a* to cylindrical surface 713, and frustoconical surface 714 tapers radially outward from axis 705 when moving axially from cylindrical surface 713 to downhole engagement surface 719*b*. As will be described in more detail below, frustoconical landing surface 711 is configured to engage with a flowable plug member to close off a central passage through plug assembly 700 (e.g., central passage 702 described below) during operations.

Radially outer surface 110*d* includes a cylindrical surface 715 extending axially from uphole engagement surface 719*a*, a frustoconical surface 716 extending from cylindrical surface 715, and a cylindrical surface 718 extending axially from frustoconical surface 716 to downhole engagement surface 719*b*. Frustoconical surface 716 tapers radially inward toward axis 705 when moving axially from uphole engagement surface 719*a* toward cylindrical surface 718. In this embodiment, frustoconical surface 716 and cylindrical surface 718 are connected to one another with a concave radius 717.

Figure 18:
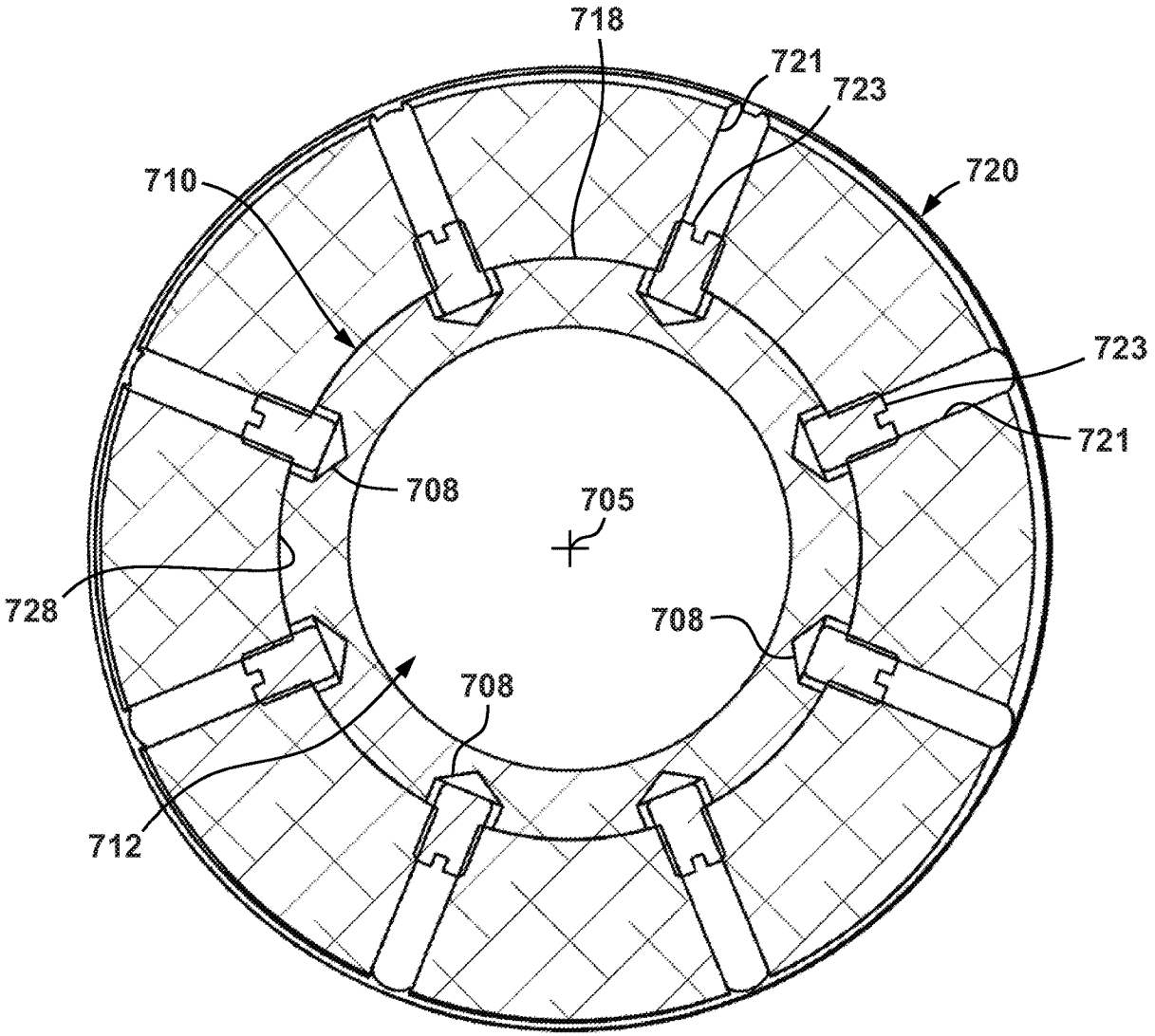
FIG. 18 is a cross-sectional view along section B-B in FIG. 15.

Ball seat 710 includes a plurality of recesses 708 extending radially inward from cylindrical surface 718. In particular, as is best shown in FIG. 18, in this embodiment, ball seat 710 comprises eight recesses 708 that are evenly circumferentially spaced about axis 705. Each recess 708 receives a shear pin 723 therethrough to selectively fix an initial relative axial and circumferential position of ball seat 710 and seal sub 720.

Referring again to FIGS. 16 and 17, sealing element 740 is a generally annular member that includes a first or uphole end 740*a*, a second or downhole end 740*b* opposite uphole end 740*a*, a radially inner surface 740*c* extending between ends 740*a*, 740*b*, and a radially outer surface 740*d* also extending between ends 740*a*, 740*b*. As with sealing element 131 previously described above, sealing element 740 may comprise a compliant and/or elastomeric material such that member 740 may sealingly engage with an inner surface of a wellbore tubular (e.g., a casing pipe disposed within a subterranean wellbore) to seal off the central passage of the tubular during operations Radially inner surface 740*c* defines a throughbore 744 extending axially between ends 740*a*, 740*b* that includes a frustoconical surface 741 extending from uphole end 740*a*, and a cylindrical surface 743 extending from downhole end 740*b*. Frustoconical surface 741 tapers radially inward toward axis 705 when moving axially from uphole end 740*a* toward cylindrical surface 743. In this embodiment, frustoconical surface 741 and cylindrical surface 743 are connected to one another with a convex radius 742.

Radially outer surface 740*d* includes a first of uphole cylindrical surface 745 extending axially from uphole end 740*a*, a first or uphole frustoconical surface 746 extending from uphole cylindrical surface 745, a second or downhole cylindrical surface 747 extending from uphole frustoconical surface 746, and a second or downhole frustoconical surface 748 extending from downhole cylindrical surface 747 to downhole end 740*b*. Uphole frustoconical surface 746 tapers radially inward toward axis 705 when moving axially from uphole cylindrical surface 745 to downhole cylindrical surface 747, and downhole frustoconical surface 748 tapers radially inward toward axis 705 when moving from downhole cylindrical surface 747 to downhole end 740*b*.

Referring still to FIGS. 16 and 17, support ring 750 is a generally cup-shaped member that includes a first or uphole end 750*a*, a second or downhole end 750*b* opposite uphole end 750*a*, and a throughbore 751 extending axially between ends 750*a*, 750*b*. In addition, support ring 750 includes a cylindrical section 752 extending axially from uphole end 750*a*, and a frustoconical section 754 extending from cylindrical section 752 to downhole end 750*b*. Frustoconical section 754 tapers radially inward toward axis 705 when moving axially from cylindrical section 752 to downhole end 750*b*. A plurality of axially extending slots 756 extend from uphole end 750*a* through cylindrical section 752, such that a plurality of axially extending petals or collets 758 are defined along cylindrical section 752 that are circumferentially spaced about axis 705.

Referring still to FIGS. 16 and 17, seal sub 720 is a generally tubular member that includes a first or uphole end 720*a*, a second or downhole end 720*b* opposite uphole end 720*a*, a receptacle 732 extending from uphole end 720*a* to a circumferential groove or channel 735, and a coupling portion or section 734 extending from channel 735 to downhole end 720*b*. In addition, seal sub 720 includes a throughbore 722 extending axially between ends 720*a*, 720*b* along axis 705, and thus through each of the receptacle 732 and the coupling section 734. Within receptacle 732, throughbore 722 is defined by a cylindrical surface 724 extending axially from uphole end 720*a*, and a frustoconical surface 726 extending from cylindrical surface 724. Within coupling section 734, throughbore 722 is defined by a cylindrical surface 728 extending axially from frustoconical surface 726, a radially extending annular shoulder 730, a cylindrical surface 731 extending axially from shoulder 730, and a frustoconical surface 733 extending from cylindrical surface 731 to downhole end 720*b*. Frustoconical surface 726 tapers radially inward toward axis 705 when moving axially from cylindrical surface 724 to cylindrical surface 728, and frustoconical surface 733 tapers radially outward from axis 705 when moving axially from cylindrical surface 731 to downhole end 720*b*.

As is best shown in FIG. 17, receptacle 732 is separated into a plurality of axially extending collets or fingers 729 by a plurality of axially extending slots 736 that extend from circumferential groove 735 to uphole end 720*a*. In this embodiment, collets 729 are evenly circumferentially spaced about axis 705.

Referring still to FIGS. 16 and 17, coupling section 734 includes a tapered outer surface 738 that tapers radially inward toward axis 705 when moving from circumferential groove 735 to downhole end 720*b*. In addition, tapered outer surface 738 includes a wicker style thread profile that includes a plurality of axially separated frustoconical surfaces 737 extending circumferentially about axis 705, and a plurality of shoulders 739 extending radially between axially adjacent frustoconical surfaces 737. The wicker thread profile defined by frustoconical surfaces 737 and shoulders 739 engages with the corresponding thread profile of slip sub 140 to secure seal sub 720 and slip sub 140 to one another during operations in a similar manner to that described above for plug assembly 100.

Coupling section 134 also includes a plurality of bores 721 that each extend radially from outer surface 738 to cylindrical surface 728 of throughbore 722. As is best shown in FIG. 18, each of the bores 721 is circumferentially aligned with one of recesses 708 on ball seat 710 when ball seat 710 is received within seal sub 720 as shown. As a result, the shear pins 723 (previously described) each extend through a corresponding pair of the recesses 708 and bores 721 between ball seat 710 and seal sub 720. In this embodiment, there are a total of eight bores 721 that are evenly circumferentially spaced about axis 705 along coupling section 734, so as to match the number and arrangement of recesses 708 with ball seat 710 as previously described. Accordingly, shear pins 723 fix initial relative axial and circumferential positions of ball seat 710 and seal sub 720.

Referring still to FIGS. 16 and 17, to make up plug assembly 700, support ring 750 is inserted within receptacle 732 of seal sub 720 such that cylindrical section 752 engages with cylindrical surface 724 and frustoconical section 754 engages with frustoconical surface 726. In addition, as is best shown in FIG. 15, the slots 756 formed within support ring 750 are circumferentially misaligned with the slots 736 formed in receptacle 732 such that collets 758 on ring 750 are circumferentially misaligned with collets 729 on seal sub 720. Without being limited to this or any other theory, the circumferential misalignment of slots 756, 736 on support ring 750 and receptacle 732 of seal sub 720 prevent seal member 730 from extruding radially through the support ring 750 and receptacle 732 during operations.

Figure 20:
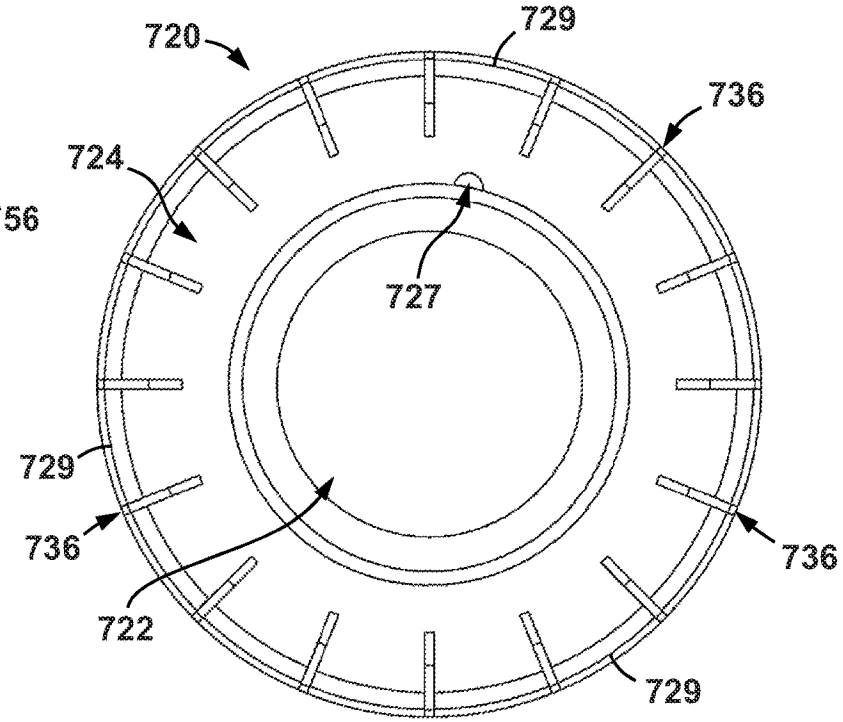
FIG. 20 is a top view of the seal sub of the plug assembly of FIG. 15.
Figure 19:
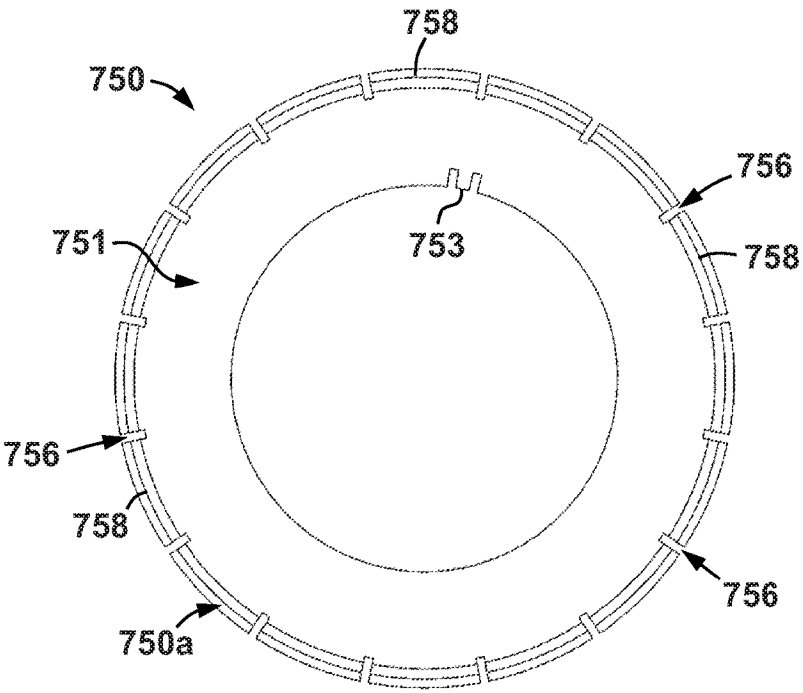
FIG. 19 is a top view of the support ring of the plug assembly of FIG. 15.

Referring briefly to FIGS. 19 and 20, in some embodiments, support ring 750 may include a tab 753 formed within throughbore 751, and seal sub 720 may include an aperture 727 within receptacle 724. During operations, when support ring 750 is inserted within receptacle 724 of seal sub 720 along axis 705 as previously described (see e.g., FIG. 17), the tab 753 on support ring 750 may be circumferentially aligned with aperture 727 such that tab 753 may be deformed (e.g., bent) into aperture 727 to fix the relative circumferential positions of support ring 740 and seal sub 720. In at least some embodiments, the positioning of tabs 753 and aperture 727 may allow for the circumferential misalignment of slots 756, 736 and collets 758, 729 previously described above when tab 753 is aligned with an inserted within aperture 727.

Referring again to FIGS. 16 and 17, seal member 740 is installed within throughbore 751 of support ring 750 such that frustoconical surface 748 engages with frustoconical section 754 and frustoconical surface 747 engages with cylindrical section 752. Finally, ball seat 710 is received axially through throughbores 744 and 751 of the seal member 740 and support ring 750, respectively, and into throughbore 722 of seal sub 720 such that cylindrical surface 718 is engaged with cylindrical surface 743 within throughbore 744 of seal member 740, and cylindrical surface 728 within throughbore 722 of seal sub 720. In addition, when ball seat 710 is initially installed within throughbores 744, 722 of seal member 740 and seal sub 720, respectively, the frustoconical surface 726 on seat 710 is engaged with the frustoconical surface 741 on seal member 740. As a result, seal member 740 is axially captured or engaged between frustoconical surface 716 on ball seat 710 and frustoconical section 754 on support ring 750. Further, when ball seat 710 is initially inserted within throughbore 722 of seal sub 720, recesses 708 within throughbore 712 of seat 710 are circumferentially aligned with bores 721 in seal sub 720 and shear pins 723 are inserted therethrough as previously described above.

As best shown in FIG. 16, when ball seat 710, seal sub 720, and slip sub 140 are all coupled to one another, a central through passage 702 is formed through plug assembly 700 that extends between ends 700*a*, 700*b* and that is defined by throughbores 712, 722 of ball seat 710 and seal sub 720 and through passage 144 of slip sub 140. As a result, fluids flowing through a wellbore tubular (e.g., a casing pipe) may pass through plug assembly 700 via through passage 702 as long as passage 702 is not blocked or sealed (e.g., with a frac ball or other suitable valving member).

Operations with plug assembly 700 are substantially the same as those described above for plug assembly 100. In particular, to install plug assembly 700 within a wellbore tubular (e.g., such as casing pipe 50, previously described), the plug assembly 700 is mounted to a downhole end of a suitable setting tool or adapter therefor (e.g., such as setting tool adapter 200, previously described) and is then inserted within the wellbore tubular. Thereafter, the setting tool and/or adapter is actuated to compress ends 700*a*, 700*b* of plug assembly 700 axially toward one another to thereby radially deploy sealing element 740 and collets 142*a* on slip sub 140 toward an inner surface or wall of the wellbore tubular 50.

Figure 21:
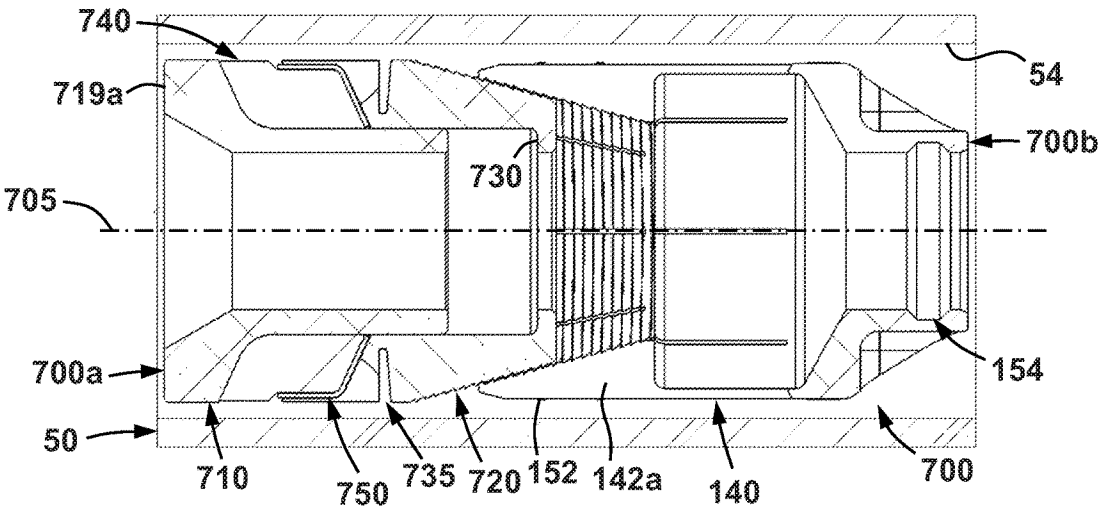
FIG. 21 is a side cross-sectional view of the plug assembly of FIG. 15 disposed within a wellbore tubular.
Figure 22:
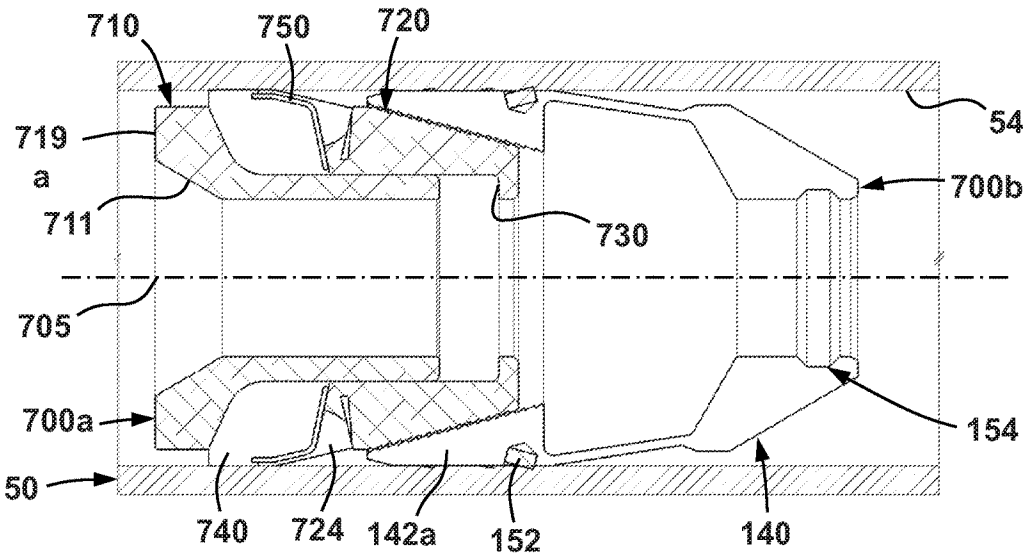
FIG. 22 is a side cross-sectional view of the plug assembly of FIG. 15 installed within a wellbore tubular.

In particular, referring now to FIGS. 21 and 22, during operations, plug assembly 700 is installed onto a setting tool (e.g., via an appropriate adapter such as adapter 200 previously described) and is inserted within a wellbore tubular, which in this embodiment comprises casing pipe 50. As is similarly described above for plug assembly 100, the setting tool (or the appropriate adapter) engages with uphole engagement surface 719*a* on ball seat 710 and recess 154 within slip sub 140, proximate downhole end 700*b*. Thereafter, when plug assembly 700 is to be installed within casing pipe 50, the setting tool (not shown) applies an axially compressive load between ends 700*a*, 700*b* via the engagement at uphole engagement surface 719*a* and recess 154 such that slip sub 140 is forced axially toward ball seat 710 and seal sub 720. As a result, inner tapered surface 146 of slip sub 140 slidingly advances over outer tapered surface 738 on seal sub 720 and radial shoulders 147 formed on inner tapered surface 146 progressively ratchet past corresponding ones of the radial shoulders 739 on inner tapered surface 738 (see engagement between shoulders 147, 739 in FIG. 16). In addition, as inner tapered surface 146 is forced over inner tapered surface 738 (or inner tapered surface 738 is forced into outer tapered surface 146), the taper of surfaces 738, 146 facilitate a radially outwardly directed (i.e., away from axis 705) load that is transferred to collets 142*a*. Initially, radial deformation of collets 142*a* is prevented by connecting members 141 disposed within slots 143 (see e.g., FIGS. 2 and 4); however, as slip sub 140 continues to be forced axially over coupling section 734 of seal sub 720, the radially outward directed load on collets 142*a* increases such that connecting members 141 (or at least some of the connecting members 141) fail (e.g., fracture) therefore allowing collets 142*a* to radially expand toward an inner surface or wall 54 of casing 50. The radial expansion of collets 142*a* also causes buttons 152 to embed themselves within inner wall 54 to therefore fix the axial position of plug assembly 700 within casing 50 as shown in FIG. 20.

Referring still to FIGS. 21 and 22, following the initial expansion of collets 142*a*, continued axial compression of plug assembly 700 eventually fractures shear pins 723 (see FIG. 18) extending between ball seat 710 and seal sub 720 so that seal sub 720 is forced axially uphole and over ball seat 710 (or ball seat 710 is forced axially downhole and within seal sub 720). During this process, seal member 740 is compressed between frustoconical surface 716 on ball seat 710 and frustoconical surface 754 on support ring 750, and is therefore radially expanded outward (i.e., away from axis 705) to sealingly engage with inner wall 54 of casing pipe 50. Thereafter, fluid communication within casing 50 between inner wall 54 and plug assembly 700 is prevented (or at least restricted). This radial expansion of seal member 740 is also facilitated by a radial deflection of collets 758 on support ring 750 and collects 729 on seal sub 720. In addition, the radial deflection of collets 729 is further facilitated by circumferential groove 735 due to the reduced wall thickness in seal sub 720 at groove 735. In addition, the absence of material within groove 735 creates space that further facilitates the movement and deflection of collets 729 previously described. In this embodiment, shear pins 723 are configured such that they fail after connecting members 141 between collets 142*a* on slip sub 140. Therefore, in this embodiment, collets 142*a* radially expand before sealing element 730 is radially expanded. In addition, during the above described operations, seal sub 720 may be axially advanced over ball seat 710 (or ball 710 may be axially advanced over seal sub 720) until downhole engagement surface 719*b* engages or abuts with annular shoulder 730 within throughbore 722 of seal sub 720.

Referring now to FIG. 22, eventually it may be come desirable to seal a section of casing 50 that is uphole from plug assembly 700 from the section of casing 50 that is downhole of plug assembly 700 (e.g., such as during a hydraulic fracturing operation as described above). To effect a sealed fluid barrier within casing 50 at the installed plug assembly 700, a ball (or dart or any other suitable flowable plugging member as previously described) (e.g., ball 300 previously described) is pumped from the surface into the casing 50 until it lands on frustoconical surface 711 of ball seat 710. The engagement between the ball and frustoconical surface 711 creates an additional seal that prevents fluids within casing 50 from flowing through central through passage 702 of plug assembly 700. In addition, fluids are prevented from migrating between ball seat 710 and seal sub 720 due to the radially expanded seal member 730 (particularly due to the sealing engagement between cylindrical surface 743 of seal member 740 and cylindrical surface 718 of ball seat 710. After the ball is landed on ball seat 710 (particularly frustoconical surface 711) and through passage 702 is sealed as described above, the portion of the casing 50 uphole of plug assembly 700 may be pressurized (e.g., to 10,000 psi or more in some embodiments), which further urges the ball into engagement with seat 710. Because buttons 152 on collets 142*a* of slip sub 140 are embedded within inner wall 54, the axial load imparted on ball seat 710 by the landed ball may cause additional axial compression of plug assembly 700 which imparts additional radially outwardly directed loads to seal element 730 and collets 142*a* of slip sub 140 as previously described. As seal sub 720 is axially advanced farther into slip sub 140 due to the loads imparted by the ball during these operations, shoulders 739 on outer tapered surface 738 progressively ratchet further past corresponding shoulders 147 of inner tapered surface 146. As a result, when the pressure within the casing pipe uphole of plug assembly 700 is reduced (and the axially compressive loads on plug assembly 700 are removed), seal sub 720 is prevented from axially withdrawing from slip sub 140 due to engagement between the corresponding shoulders 739, 147.

Following these operations, it may no longer become necessary to provide a sealed barrier within casing pipe 50. As a result, plug assembly 700 may be removed from casing 50 following the above described pressurization operations. In some embodiments, plug assembly 700 may be milled with a drill or milling bit that is inserted and rotated within casing on the end of a tubular string. In other embodiments, most (or all) of the components of plug assembly 700 are constructed from dissolvable materials (e.g., a dissolvable alloys) that dissolve as a result of contact with the fluids disposed within casing 50. For example, in some specific embodiments, all components of plug assembly 700 are constructed from one or more such dissolvable alloys, with the exception of buttons 152. In these embodiments, the dissolvable materials making up plug assembly 700 are selected and engineered to dissolve after a sufficient amount of time has elapsed (e.g., a sufficient amount of time to allow for the installation of plug assembly 700 within casing 50 and to carry out the desired pressurization operations described above). As a result, following the cessation of pressurization operations (e.g., such for performing hydraulic fracturing of the subterranean formation), the flow path defined by casing may be once again fully open or substantially unobstructed by plug assembly 700, such that production of the wellbore may commence thereafter.

Figure 23:
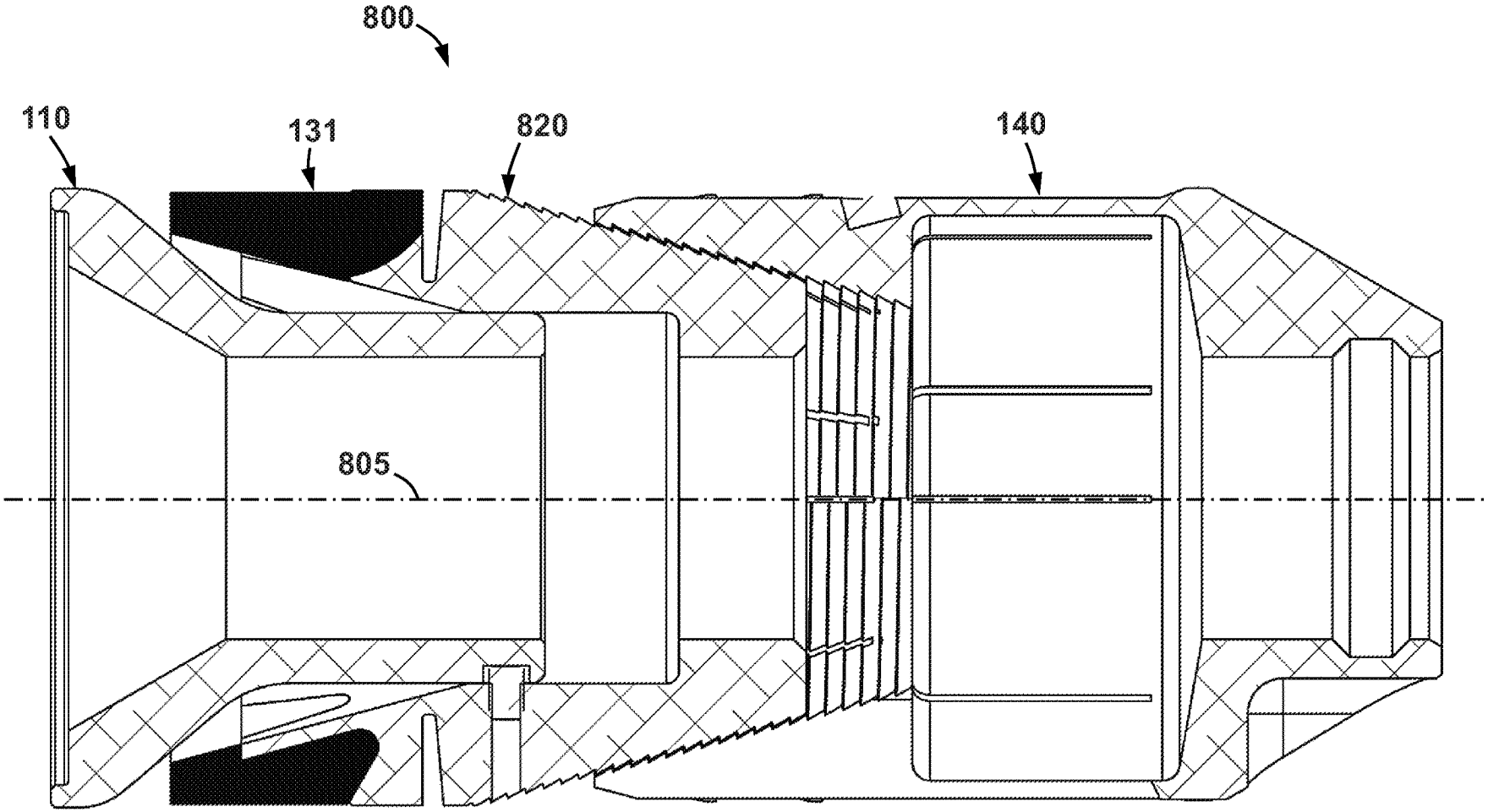
FIG. 23 is a side cross-sectional view of a plug assembly for use within a subterranean wellbore tubular according to some embodiments.

Referring now to FIG. 23, an embodiment of a plug assembly 800 for use within a subterranean wellbore tubular is shown. Generally speaking, plug assembly 800 includes ball seat 110, a seal sub 820, and slip sub 140 all coupled to one another along a central or longitude axis 805, wherein ball seat 110 and slip sub 140 are generally the same as that described above for plug assembly 100.

Figure 24:
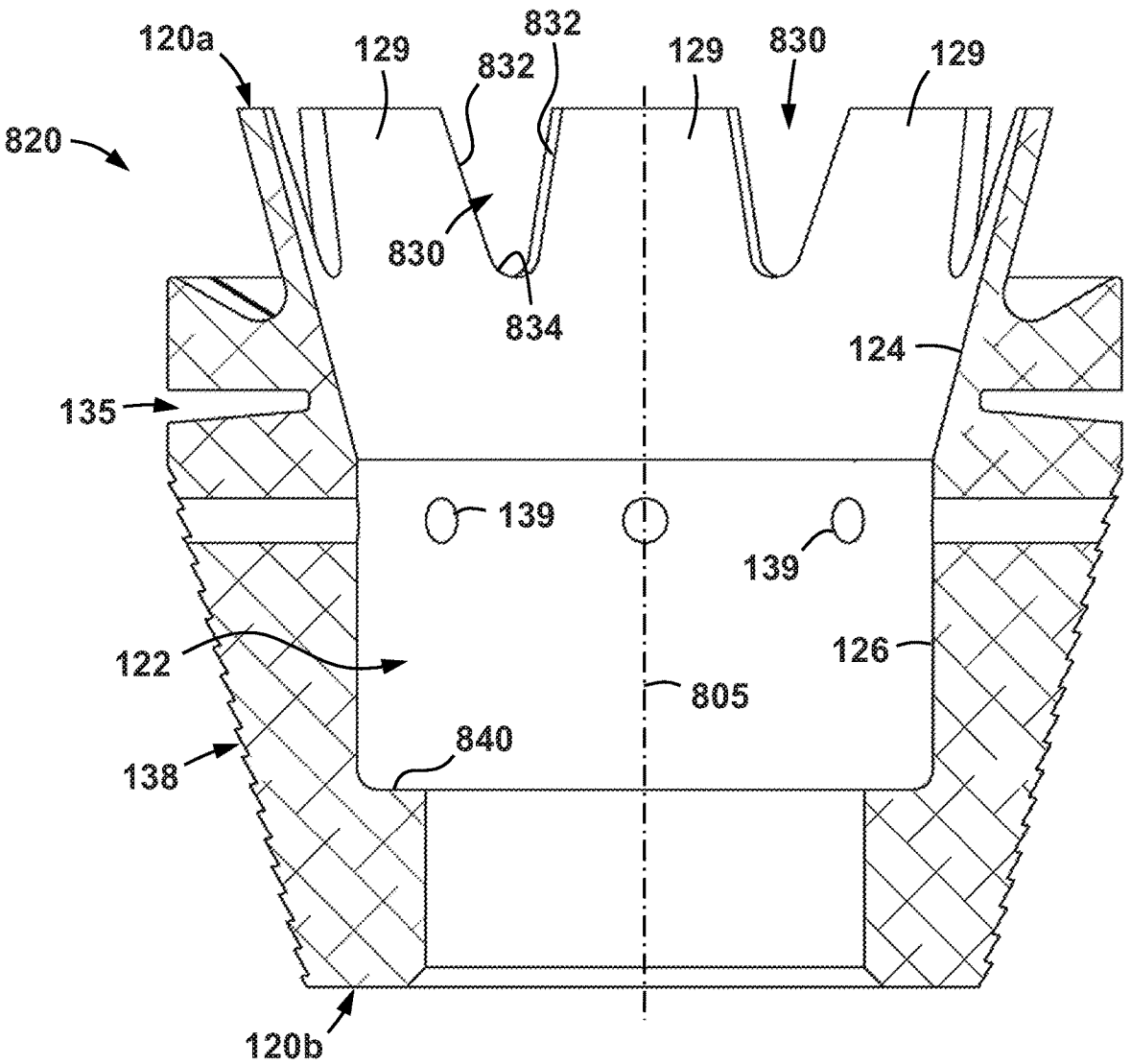
FIG. 24 is a side cross-sectional view of a seal sub of the plug assembly of FIG. 23.

Referring now to FIGS. 23 and 24, seal sub 820 is generally the same as seal sub 120, previously described, and thus, like components are identified with the same reference numerals. However, in place of axially extending slots 133*a* (see FIG. 1) seal sub 820 includes a plurality of V-shaped grooves 830 that extend axially from uphole end 120*a* between each circumferentially adjacent collet 129. Specifically, each slot 830 includes a pair of linear edges 832 that converge toward one another when moving axially from uphole end 120*a* and that terminate at a concave radius 834. In addition, seal sub 830 also includes a radially extending shoulder 840 defined within throughbore 122, proximate downhole end 820*b*. Operations with plug assembly 800 are substantially the same as that described above for plug assembly 100, and thus, this description is not repeated in the interest of brevity. During these operations however, without being limited to this or any other theory, the relatively large V-shaped grooves 830 may reduce the contact with the sealing element 131 so that radial expansion of the sealing element 131 is less constrained.

Embodiments disclosed herein has provide plug assemblies (e.g., plug assembly 100, 400, 500, 600, 700, 800) for use within a wellbore tubular (e.g., casing pipe 50) that include a relatively small number of components for carrying out the sealing function thereof. As a result, subsequent removal of the plug assembly from the wellbore tubular following the use thereof may be easier. In addition, certain plug assembles described herein are also configured to utilize increased pressures within the wellbore tubular to enhance both the engagement between the slips (e.g., collets 142*a*, 443, 643, etc.) and the inner tubular wall and the engagement between the sealing element (e.g., sealing element 131, 431, etc.) and the inner tubular wall. Thus, use of plug assemblies disclosed herein may ensure a more consistent seal within the wellbore tubular during such high-pressure operations (e.g., hydraulic fracturing).

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A plug assembly for plugging a wellbore tubular, the plug assembly having a central axis and comprising:

a seal sub comprising a plurality of axially extending fingers and a tapered outer surface;

a sealing element coupled to the axially extending fingers of the seal sub;

a slip sub comprising a tapered inner surface, and a plurality of axially extending fingers, wherein the fingers of the slip sub each include one or more teeth; and a ball seal comprising a landing surface configured to engage with a plugging member;

wherein the seal sub is configured to be at least partially inserted within the slip sub so that the tapered outer surface engages with the tapered inner surface;

wherein axial advancement of the tapered inner surface within the tapered outer surface is configured to radially expand the fingers of the slip sub;

wherein the ball seat is configured to be at least partially inserted within the seal sub; and wherein axial advancement of the ball seal within the seal sub is configured to radially expand the fingers of the seal sub.

2. The plug assembly of claim 1, wherein the ball seal comprises a frustoconical outer surface; and wherein the seal sub comprises a frustoconical inner surface.

3. The plug assembly of claim 2, wherein the sealing element is axially coupled between the frustoconical outer surface of the ball seat and the frustoconical inner surface of the seal sub.

4. The plug assembly of claim 2, wherein the tapered outer surface and the tapered inner surface each comprise a plurality of radially extending shoulders, and wherein at least some of the radially extending shoulders on the tapered inner surface are configured to engage with at least some of the radially extending shoulders on the tapered outer surface when the seal sub is at least partially inserted within the slip sub.

5. The plug assembly of claim 4, wherein the frustoconical outer surface of the ball seat is configured to engage with the frustoconical inner surface of the seal sub, wherein the frustoconical outer surface has a first taper angle, wherein the frustoconical inner surface has a second taper angle, and wherein the first taper angle is different than the second taper angle.

6. The plug assembly of claim 4, wherein the seal sub comprises a plurality of axially extending grooves that define the plurality of axially extending fingers on the seal sub, and wherein the sealing element extends into and is bonded within the plurality of axially extending grooves.

7. The plug assembly of claim 6, wherein the grooves are V-shaped.

8. The plug assembly of claim 4, wherein the fingers of the slip sub are connected by a plurality of connecting members, and wherein at least some of the connecting members are configured to fracture as the tapered inner surface is axially advanced within the tapered outer surface.

9. The plug assembly of claim 4, wherein the seal sub comprises a first end, a second end opposite the first end, and a circumferential groove axially disposed between the first end and the second end;

wherein the plurality of fingers of the seal sub extend from the first end toward the circumferential groove; and wherein the tapered outer surface extends from the circumferential groove to the second end.

10. The plug assembly of claim 9, wherein the ball seat comprises:

a first end and a second end opposite the first end of the ball seat;

wherein the frustoconical outer surface of the ball seat extends from the first end of the ball seat, and wherein the ball seat further comprises a cylindrical outer surface extending from the second end of the ball seat toward the frustoconical outer surface; and wherein the cylindrical outer surface of the ball seat is configured to engage with a cylindrical inner surface of the seal sub when the ball seat is at least partially inserted within the seal sub.

11. The plug assembly of claim 10, wherein the seal sub comprises a bore that extends radially through the cylindrical inner surface, wherein the ball seat includes a recess extending radially into the cylindrical outer surface, and wherein the plug assembly further comprises a shear pin inserted through the bore in the seal sub and the recess in the ball seat.

12. The plug assembly of claim 10, wherein ball seat further comprises a throughbore extending between the first and second ends of the ball seat, wherein the throughbore of the ball seat is at least partially defined by the landing surface and a cylindrical inner surface extending from the landing surface toward the second end of the ball seat.

13. The plug assembly of claim 1, further comprising a support ring disposed between the sealing element and the seal sub, wherein the support ring comprises a plurality of axially extending petals.

14. A method of installing a plug assembly within a wellbore tubular, the method comprising:

(a) inserting the plug assembly into the wellbore tubular, wherein the plug assembly has a central axis and comprises:

a ball seat comprising a landing surface;

a seal sub comprising a plurality of axially extending fingers and a tapered outer surface;

a sealing element coupled to the seal sub; and a slip sub comprising a tapered inner surface and a plurality of axially extending fingers, wherein the fingers of the slip sub each include one or more teeth;

(b) axially advancing the tapered inner surface of the slip sub over the tapered outer surface of the seal sub;

(c) radially expanding the axially extending fingers of the slip sub to engage the one or more teeth with an inner wall of the wellbore tubular during (b);

(d) axially advancing the ball seat within the seal sub; and (e) radially expanding the axially extending fingers of the seal sub and the sealing element toward the inner wall of the wellbore tubular during (d).

15. The method of claim 14, wherein (d) occurs after (c).

16. The method of claim 15, further comprising fracturing a shear pin extending between the ball seat and the seal sub after (c) and before (d).

17. The method of claim 14, wherein the tapered outer surface and the tapered inner surface each comprise a plurality of radially extending shoulders, and wherein the method further comprises engaging at least some of the radially extending shoulders on the tapered inner surface with at least some of the radially extending shoulders on the tapered outer surface.

18. The method of claim 14, further comprising:

(f) landing a plugging member on the landing surface after (e); and (g) pressurizing the wellbore tubular uphole of the plug assembly after (f); and (h) axially advancing the tapered outer surface of the slip sub further over the tapered inner surface of the seal sub as a result of (g).

19. The method of claim 18, wherein the tapered outer surface and the tapered inner surface each comprise a plurality of radially extending shoulders; and wherein the method further comprises:

(i) lowering the pressure within the wellbore tubular, uphole of the plug assembly after (h); and (j) engaging at least some of the plurality of radially extending shoulders on the tapered outer surface of the seal sub with at least some of the plurality of radially extending shoulders on the tapered inner surface of the slip sub during (i); and (k) preventing the axial withdrawal of the seal sub from the slip sub due to the engagement in (j).

20. A plug assembly for plugging a wellbore tubular, the plug assembly having a central axis and comprising:

a ball seat comprising a landing surface and a frustoconical outer surface, wherein the landing surface is configured to engage with a plugging member;

a seal sub comprising a plurality of axially extending fingers a frustoconical inner surface, and a tapered outer surface;

a sealing element coupled to the frustoconical outer surface of the ball seat and the frustoconical inner surface of the seal sub; and a slip sub comprising a plurality of axially extending fingers, each including one or more teeth, and a tapered inner surface;

wherein the ball seat is at least partially received within the seal sub;

wherein the seal sub is at least partially received within the slip sub such that the tapered outer surface of the seal sub is engaged with the tapered inner surface of the slip sub;

wherein axial advance of the ball seat into the seal sub is configured to radially expand the fingers of the seal sub and the sealing element; and wherein axial advance of the tapered outer surface of the seal sub within the tapered inner surface of the slip sub is configured to radially expand the fingers of the slip sub.

* * * * *